US011846892B2

(12) United States Patent
Ariizumi et al.

(10) Patent No.: US 11,846,892 B2
(45) Date of Patent: Dec. 19, 2023

(54) DEVELOPING DEVICE

(71) Applicant: CANON KABUSHIKI KAISHA, Tokyo (JP)

(72) Inventors: Osamu Ariizumi, Chiba (JP); Jun Shirayanagi, Ibaraki (JP); Fumiyoshi Saito, Ibaraki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/989,907

(22) Filed: Nov. 18, 2022

(65) Prior Publication Data

US 2023/0168599 A1 Jun. 1, 2023

(30) Foreign Application Priority Data

Nov. 26, 2021 (JP) ..... 2021-192002

(51) Int. Cl.
*G03G 15/01* (2006.01)

(52) U.S. Cl.
CPC . *G03G 15/0173* (2013.01); *G03G 2215/0177* (2013.01)

(58) Field of Classification Search
CPC ..... G03G 15/0173; G03G 2215/0177; G03G 15/09; G03G 15/0893; G03G 15/089; G03G 15/0822; G03G 15/0839; G03G 15/0877; G03G 15/0891; G03G 2215/0827; G03G 2215/0833
See application file for complete search history.

(56) References Cited

U.S. PATENT DOCUMENTS

| | | | | |
|---|---|---|---|---|
| 9,291,945 | B2 | 3/2016 | Saito | |
| 9,405,230 | B2 | 8/2016 | Akedo | |
| 9,658,573 | B2 | 5/2017 | Saito | |
| 10,126,683 | B2 | 11/2018 | Ariizumi | |
| 10,191,409 | B2 | 1/2019 | Saito | |
| 10,261,444 | B2 | 4/2019 | Shirayanagi | |
| 10,996,588 | B1 * | 5/2021 | Kato | G03G 15/0893 |

(Continued)

FOREIGN PATENT DOCUMENTS

| | | | |
|---|---|---|---|
| JP | 2015-206848 | A | 11/2015 |
| JP | 2016-061962 | A | 4/2016 |

(Continued)

*Primary Examiner* — Francis C Gray
(74) *Attorney, Agent, or Firm* — VENABLE LLP

(57) ABSTRACT

A developing device includes a rotatable developing member, a developing container, a first communication opening, a second communication opening, a first feeding screw including a first rotation shaft, first and second blade portions, a second feeding screw including a second rotation shaft, third and fourth blade portions, a developer discharge opening provided upstream of an upstream end of the second communication opening in a first direction, and a third communication opening provided upstream of the upstream end of the second communication opening in the first direction. In a second direction opposite to the first direction, the third communication opening overlaps with the second blade portion. In the first direction, the third communication opening overlaps with the fourth blade portion. In the first direction, a downstream end of the third communication opening is positioned downstream of a downstream end of the developer discharge opening.

35 Claims, 16 Drawing Sheets

(56) References Cited

U.S. PATENT DOCUMENTS

| | | | | |
|---|---|---|---|---|
| 2009/0103952 | A1 | 4/2009 | Sakamoto et al. | |
| 2010/0104305 | A1* | 4/2010 | Morimoto | G03G 15/0853 399/256 |
| 2010/0322670 | A1* | 12/2010 | Ishiguro | G03G 15/0887 399/254 |
| 2011/0058824 | A1* | 3/2011 | Morimoto | G03G 15/0887 399/27 |
| 2012/0070194 | A1* | 3/2012 | Okuno | G03G 15/0844 399/254 |
| 2013/0202328 | A1* | 8/2013 | Kimura | G03G 15/0879 399/258 |
| 2015/0177641 | A1* | 6/2015 | Tsukada | G03G 15/0893 399/53 |
| 2022/0373931 | A1* | 11/2022 | Yamada | G03G 15/0844 |

FOREIGN PATENT DOCUMENTS

| | | | |
|---|---|---|---|
| JP | 2018-010078 | A | 1/2018 |
| JP | 2021096400 | A | 6/2021 |

* cited by examiner

DEVELOPING DEVICE

FIELD OF THE INVENTION AND RELATED ART

The present invention relates to a developing device for developing an electrostatic latent image with a developer.

In an image forming apparatus using an electrophotographic type, the electrostatic latent image formed on an image bearing member such as a photosensitive drum is developed as a toner image by the developing device. Specifically, the developer is carried on a developer carrying member provided in the developing device, and in a developing position, the toner image is formed by supplying the developer to the image bearing member. As the developing device, a developing device using a two-component developer containing toner and a carrier has been conventionally used. In the case of the developing device using the two-component developer, a developing container containing the developer includes a first chamber for supplying the developer to the developer carrying member, a second chamber partitioned from the first chamber by a partition wall, and a communication portion provided in the partition wall and capable of establishing communication between the first chamber and the second chamber. In the first chamber and the second chamber, a first feeding screw and a second feeding screw each for feeding the developer and provided, respectively. Further, by rotating the first and second feeding screws, the developer is fed and circulated between the first and second chambers while being stirred.

Further, in such a developing device a constitution employing a so-called ACR (auto carrier refresh) type in which the developing container is provided with a discharge opening for permitting discharge of the developer and then the developer deteriorated in the developing container is gradually discharged through this discharge opening has been known. For example, United State Patent Application Publication No. US2009/0103952A1 discloses a constitution in which in the first chamber, the discharge opening is provided on a side downstream of the communication portion for permitting communication of the developer from the first chamber to the second chamber. Further, Japanese Laid-Open Patent Application No. 2018-10078 discloses a constitution in which in the first chamber, the discharge opening is provided on a side upstream of the communication portion for permitting communication of the developer from the second chamber to the first chamber.

Here, by rotation of the developer carrying member, airflow is drawn from an outside to an inside of the developing device. Particularly, in the case where the developer carrying member is rotated at high speed, airflow toward the discharge opening is generated inside the developing container, so that there is a liability that the airflow is leaked to the outside through the discharge opening. When such airflow is generated, the developer in the developing container is also discharged through the discharge opening in mixture with this airflow, so that a developer amount of the developer in the developing container lowers in some instances. In this case, a developer amount of the developer supplied to the developer carrying member also lowers, so there is a liability that the lowering in developer amount has the influence on an image to be outputted, and thus an abnormal image is formed.

SUMMARY OF THE INVENTION

A principal object of the present invention is to provide a developing device which are capable of reducing an amount of a developer discharged through a developer discharge opening by airflow.

According to an aspect of the present invention, there is provided a developing device comprising: a rotatable developing member configured to carry and feed a developer containing toner and a carrier to a position where an electrostatic latent image formed on an image bearing member is developed; a developing container including a first chamber in which the rotatable developing member is provided and in which the developer is supplied to the rotatable developing member and a second chamber which is partitioned from the first chamber by a partition wall and in which the developer is circulated between itself and the first chamber; a first communication opening configured to permit communication of the developer from the first chamber to the second chamber; a second communication opening configured to permit communication of the developer from the second chamber to the first chamber; a first feeding screw provided in the first chamber and including: a first rotation shaft; a first blade portion provided downstream of an upstream end of the second communication opening with respect to a first direction from the second communication opening toward the first communication opening and formed in a helical shape on an outer peripheral surface of the first rotation shaft so as to feed the developer in the first direction; and a second blade portion provided upstream of a downstream end of the second communication opening and the first blade portion with respect to the first direction and formed in a helical shape on the outer peripheral surface of the first rotation shaft so as to feed the developer in a second direction opposite to the first direction; a second feeding screw provided in the second chamber and including: a second rotation shaft; a third blade portion provided upstream of a downstream end of the second communication opening with respect to the second direction and formed in a helical shape on an outer peripheral surface of the second rotation shaft so as to feed the developer in the second direction; and a fourth blade portion provided downstream of an upstream end of the second communication opening and the third blade portion with respect to the second direction and formed in a helical shape on the outer peripheral surface of the second rotation shaft so as to feed the developer in the first direction; a developer discharge opening provided in the first chamber and disposed upstream of the upstream end of the second communication opening with respect to the first direction so as to discharge the developer from the developing container; and a third communication opening provided upstream of the upstream end of the second communication opening with respect to the first direction so as to permit communication of airflow between the first chamber and the second chamber, wherein with respect to the second direction, the third communication opening overlaps with the second blade portion, wherein with respect to the first direction, the third communication opening overlaps with the fourth blade portion, and wherein with respect to the first direction, a downstream end of the third communication opening is positioned downstream of a downstream end of the developer discharge opening.

According to another aspect of the present invention, there is provided a developing device comprising: a rotatable developing member configured to carry and feed a developer containing toner and a carrier to a position where an electrostatic latent image formed on an image bearing member is developed; a developing container including a first chamber in which the rotatable developing member is provided and in which the developer is supplied to the rotatable developing member and a second chamber which is partitioned from the first chamber by a partition wall and in which the developer is circulated between itself and the first chamber; a first communication opening configured to permit communication of the developer from the first chamber to the second chamber; a second communication opening configured to permit communication of the developer from the second chamber to the first chamber; a first feeding screw provided in the first chamber and including: a first rotation shaft; a first blade portion provided upstream of a downstream end of the first communication opening with respect to a first direction from the second communication opening toward the first communication opening and formed in a helical shape on an outer peripheral surface of the first rotation shaft so as to feed the developer in the first direction; a second blade portion provided downstream of an upstream end of the first communication opening and the first blade portion with respect to the first direction and formed in a helical shape on the outer peripheral surface of the first rotation shaft so as to feed the developer in the first direction; and a third blade portion provided downstream the first blade portion and upstream of the second blade portion with respect to the first direction and formed in a helical shape on the outer peripheral surface of the first rotation shaft so as to feed the developer in a second direction opposite to the first direction; a second feeding screw provided in the second chamber and including: a second rotation shaft; a fourth blade portion provided downstream of an upstream end of the first communication opening with respect to the second direction and formed in a helical shape on an outer peripheral surface of the second rotation shaft so as to feed the developer in the second direction; and a fifth blade portion provided upstream of a downstream end of the first communication opening and the fourth blade portion with respect to the second direction and formed in a helical shape on the outer peripheral surface of the second rotation shaft so as to feed the developer in the second direction; a developer discharge opening provided in the first chamber and disposed downstream of the downstream end of the first communication opening with respect to the first direction so as to discharge the developer from the developing container; and a third communication opening provided downstream of the downstream end of the first communication opening with respect to the first direction so as to permit communication of airflow between the first chamber and the second chamber, wherein with respect to the first direction, the third communication opening overlaps with the second blade portion, wherein with respect to the second direction, the third communication opening overlaps with the fifth blade portion, and wherein with respect to the first direction, an upstream end of the third communication opening is positioned upstream of an upstream end of the developer discharge opening.

According to a further aspect of the present invention, there is provided a developing device comprising: a rotatable developing member configured to carry and feed a developer containing toner and a carrier to a position where an electrostatic latent image formed on an image bearing member is developed; a developing container including a first chamber in which the rotatable developing member is provided and in which the developer is supplied to the rotatable developing member and a second chamber which is partitioned from the first chamber by a partition wall and in which the developer is circulated between itself and the first chamber; a first communication opening configured to permit communication of the developer from the first chamber to the second chamber; a second communication opening configured to permit communication of the developer from the second chamber to the first chamber; a first feeding screw provided in the first chamber and including: a first rotation shaft; a first blade portion provided downstream of an upstream end of the second communication opening with respect to a first direction from the second communication opening toward the first communication opening and formed in a helical shape on an outer peripheral surface of the first rotation shaft so as to feed the developer in the first direction; and a second blade portion provided upstream of a downstream end of the second communication opening and the first blade portion with respect to the first direction and formed in a helical shape on the outer peripheral surface of the first rotation shaft so as to feed the developer in the first direction; a second feeding screw provided in the second chamber and including: a second rotation shaft; a third blade portion provided upstream of a downstream end of the second communication opening with respect to the second direction and formed in a helical shape on an outer peripheral surface of the second rotation shaft so as to feed the developer in a second direction opposite to the first direction; a fourth blade portion provided downstream of an upstream end of the second communication opening and the third blade portion with respect to the second direction and formed in a helical shape on the outer peripheral surface of the second rotation shaft so as to feed the developer in the second direction; and a fifth blade portion provided downstream of the third blade portion and upstream of the fourth blade portion with respect to the second direction and formed in the helical shape on the outer peripheral surface of the second rotation shaft so as to feed the developer in the first direction; a developer discharge opening provided in the second chamber and disposed downstream of the downstream end of the second communication opening with respect to the second direction so as to discharge the developer from the developing container; and a third communication opening provided downstream of the downstream end of the second communication opening with respect to the second direction so as to permit communication of airflow between the first chamber and the second chamber, wherein with respect to the second direction, the third communication opening overlaps with the fourth blade portion, wherein with respect to the first direction, the third communication opening overlaps with the second blade portion, and wherein with respect to the second direction, an upstream end of the third communication opening is positioned upstream of a upstream end of the developer discharge opening.

Further features of the present invention will become apparent from the following description of exemplary embodiments with reference to the attached drawings.

Figure 8:
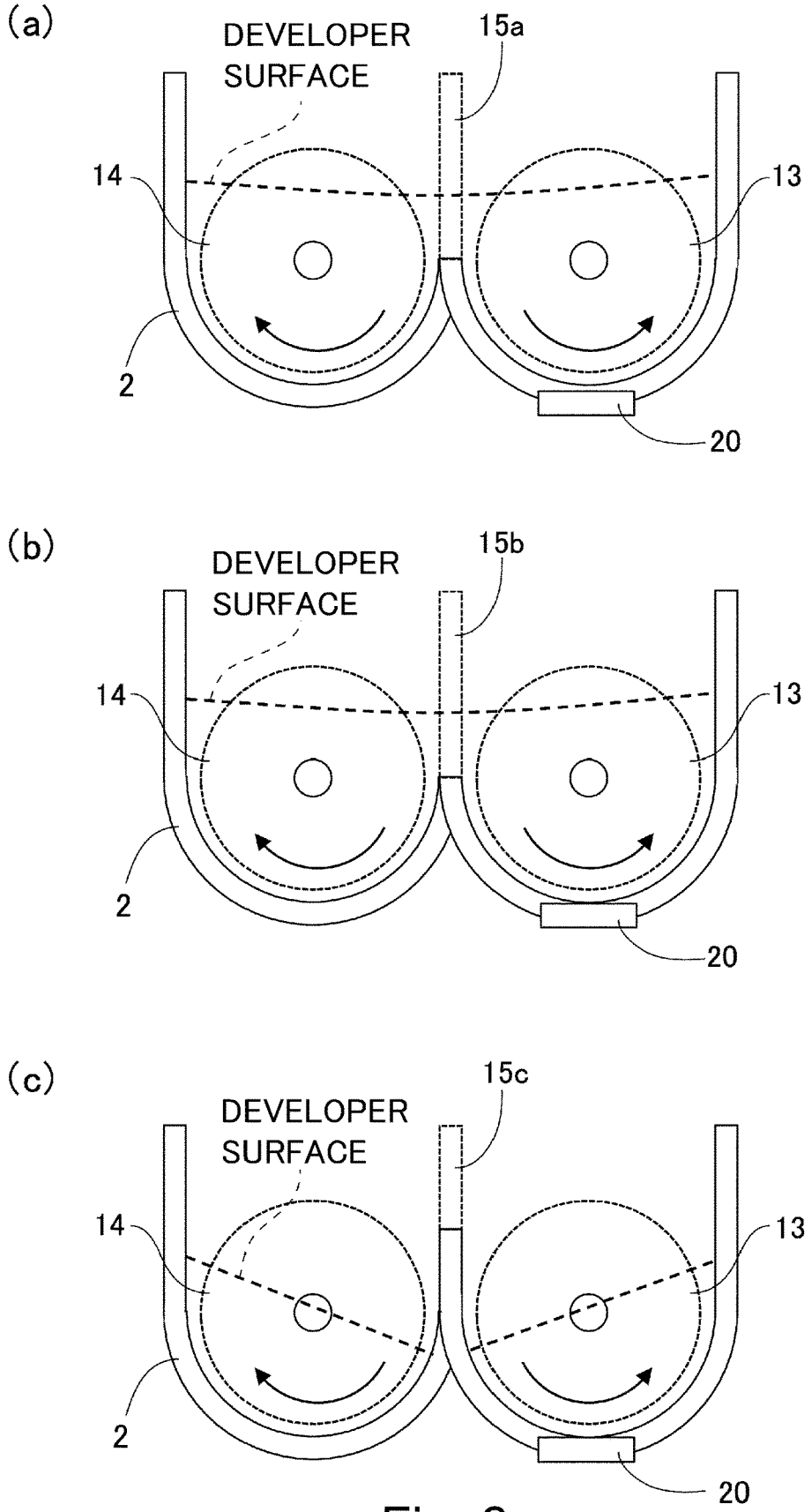

Part (a) of FIG. 8 is a schematic view showing the developing device but at a first opening, part (b) of FIG. 8 is a schematic view showing the developing device cut at a second opening, and part (c) of FIG. 8 is a schematic view showing the developing device cut at a third opening.

Figure 9:
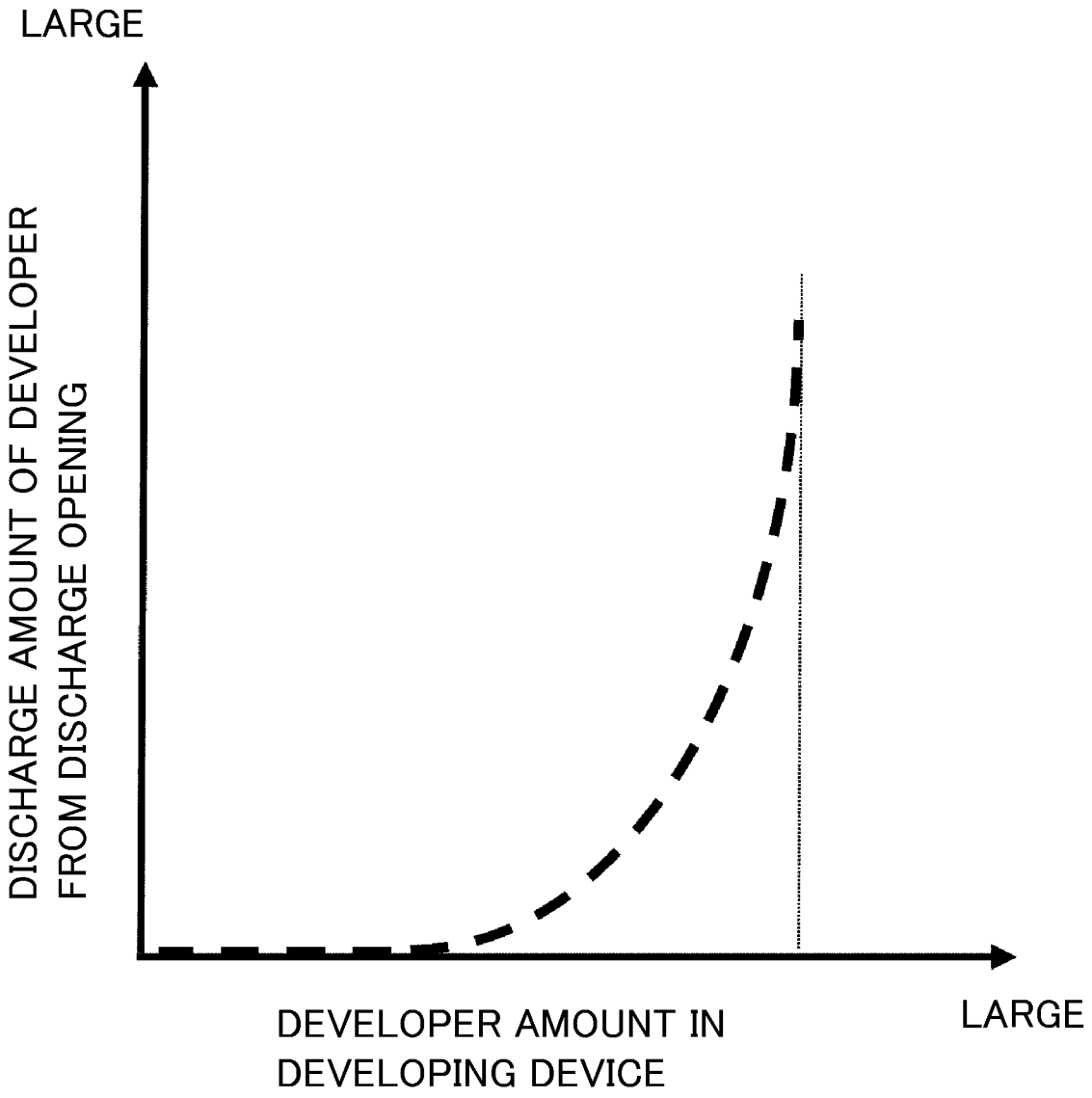

FIG. 9 is a graph showing a relationship between a developer amount in the developing device and a discharge amount of a developer through a discharge opening.

Figure 10:
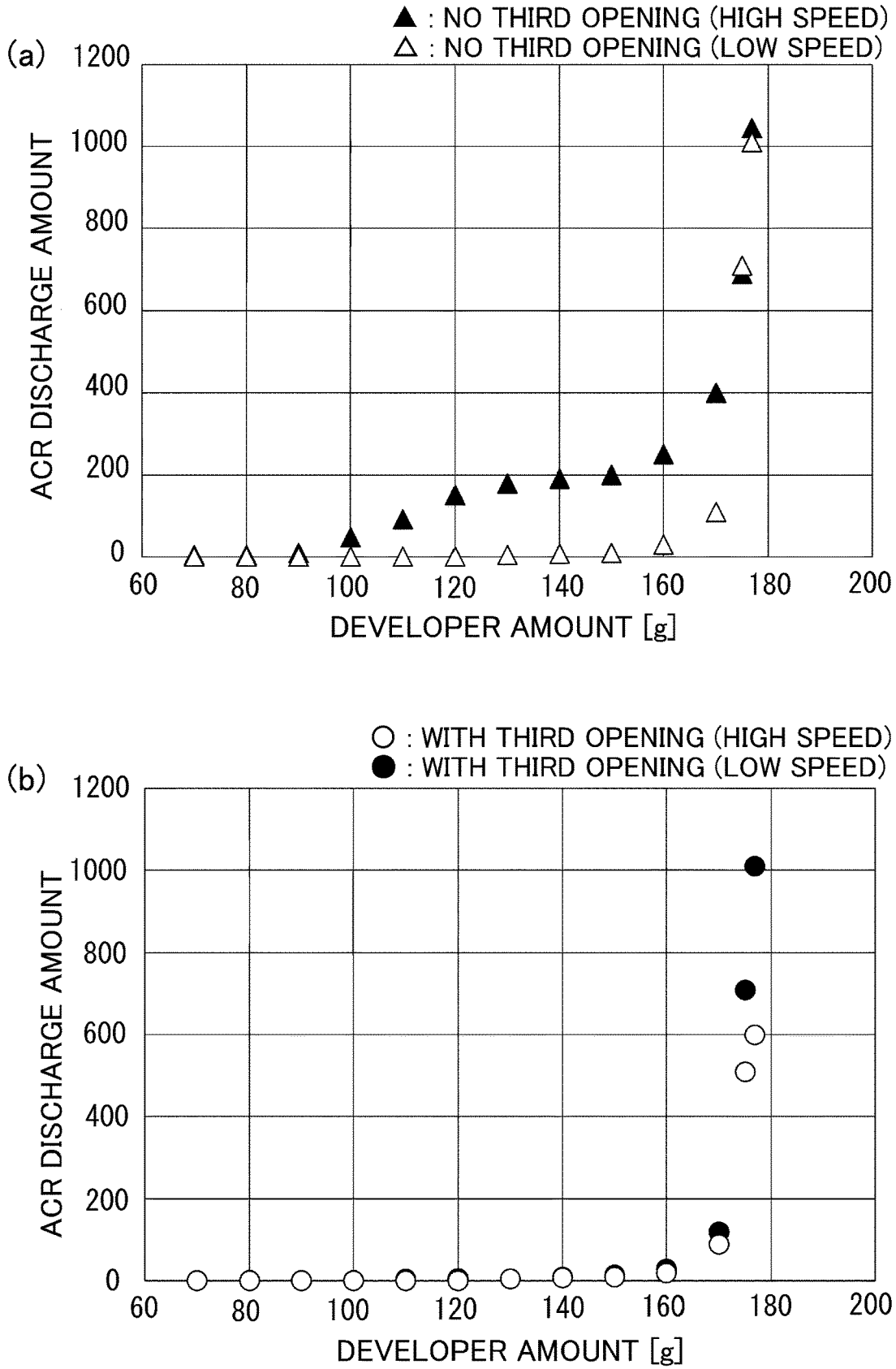

Parts (a) and (b) of FIG. 10 are graphs each showing a relationship between the developer amount and the discharge amount in the case where a rotational speed of a developing sleeve is low and the case where the rotational speed of the developing sleeve is high, in which part (a) shows the relationship in a comparison example with no third opening, and part (b) shows the relationship in the first embodiment with the third opening.

Figure 11:
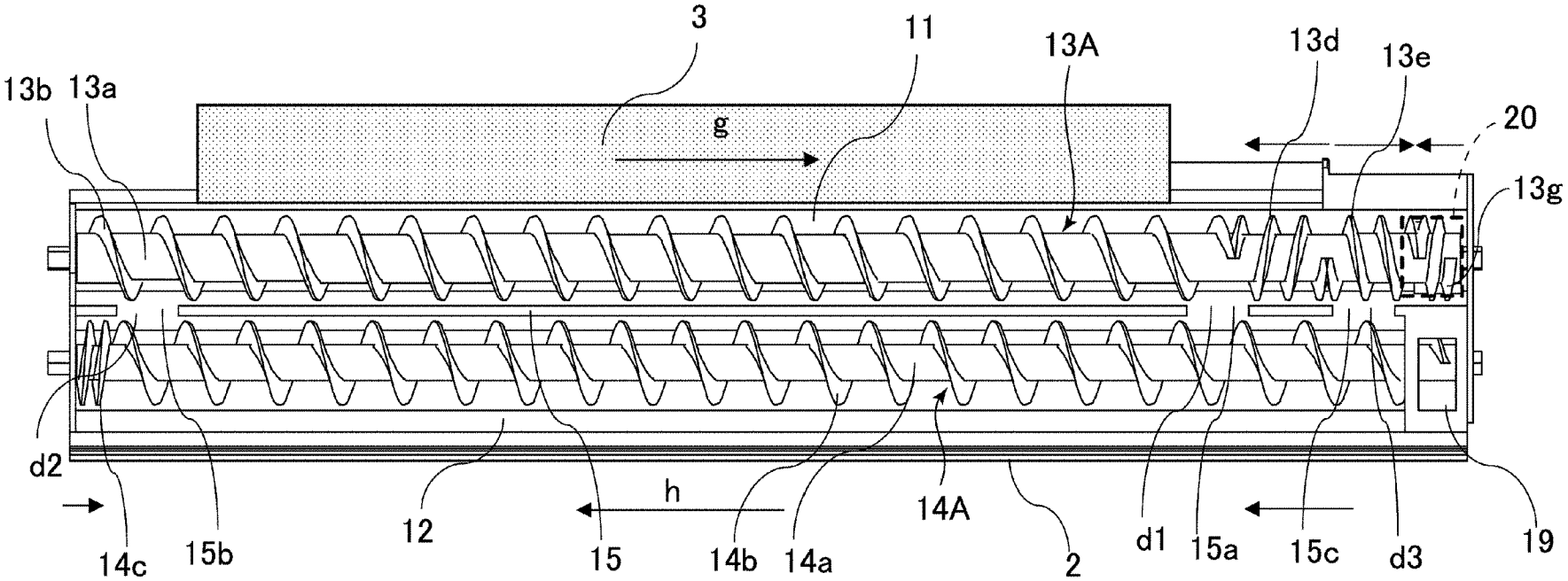

FIG. 11 is a schematic longitudinal sectional vie of a developing device according to a second embodiment.

Figure 12:
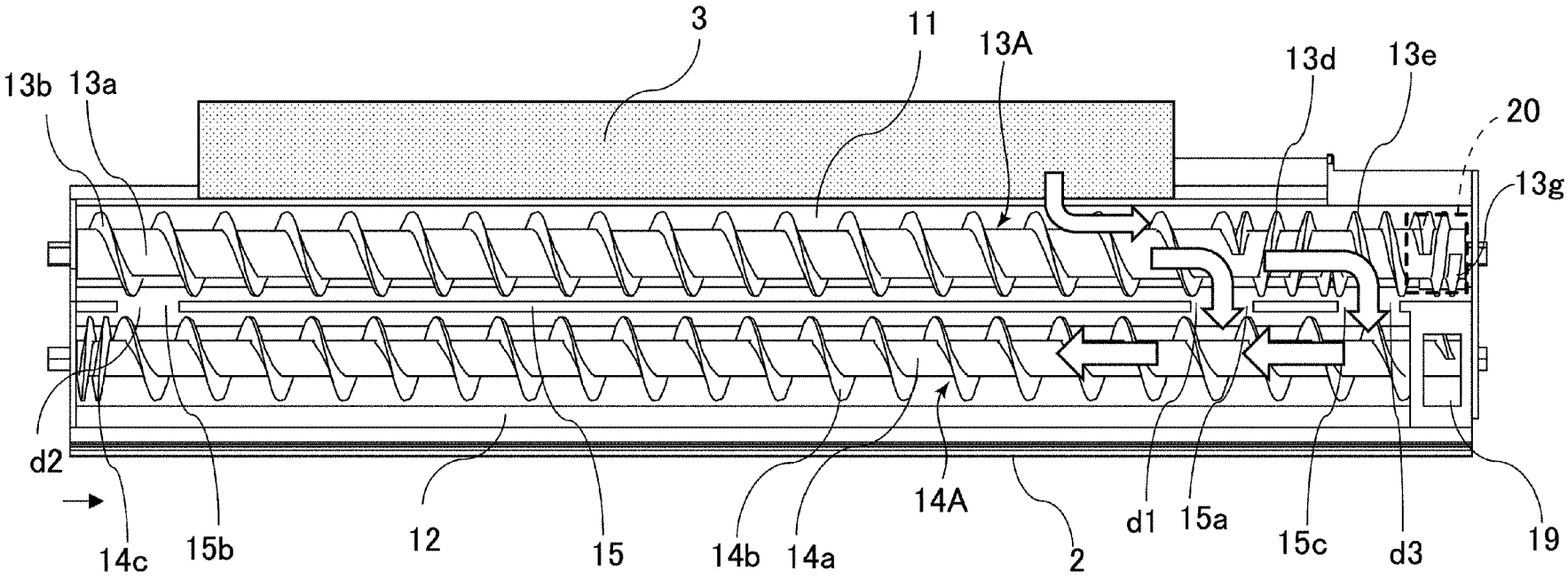

FIG. 12 is a schematic view for illustrating a flow of airflow in the developing device of the second embodiment.

Figure 13:
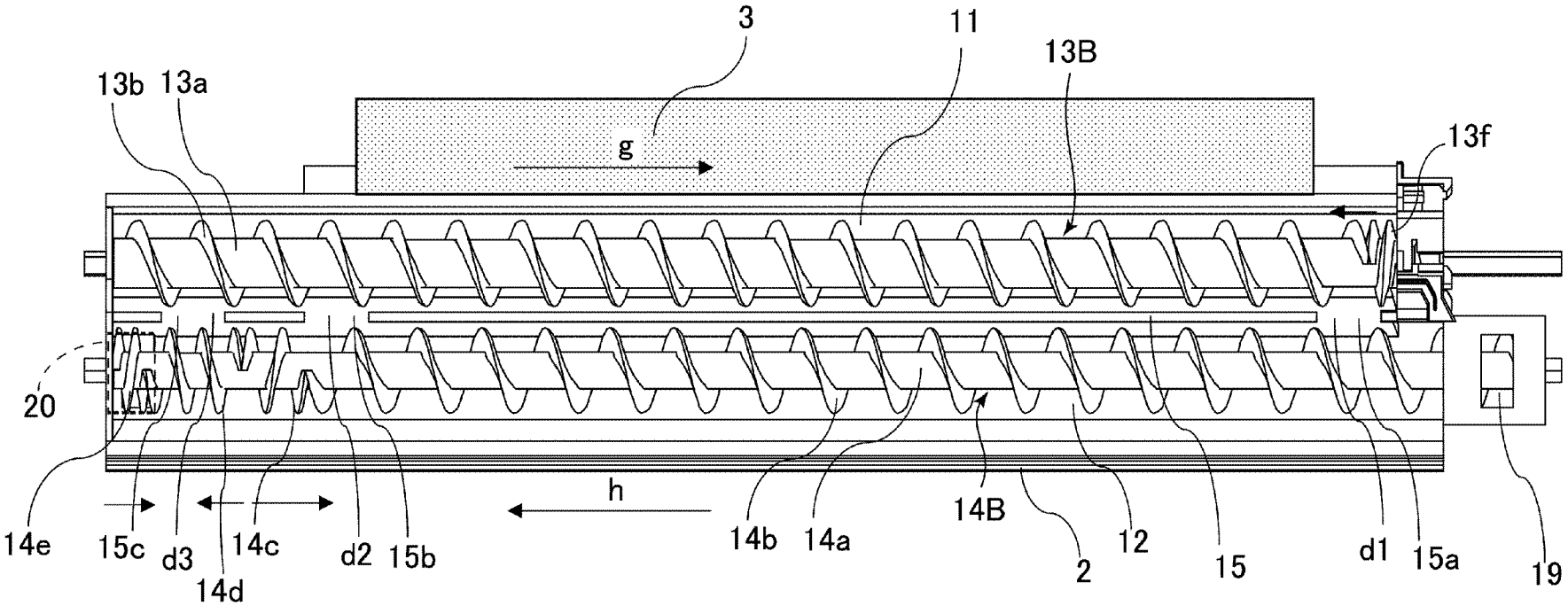

FIG. 13 is a schematic longitudinal sectional view of a developing device in a third embodiment.

Figure 14:
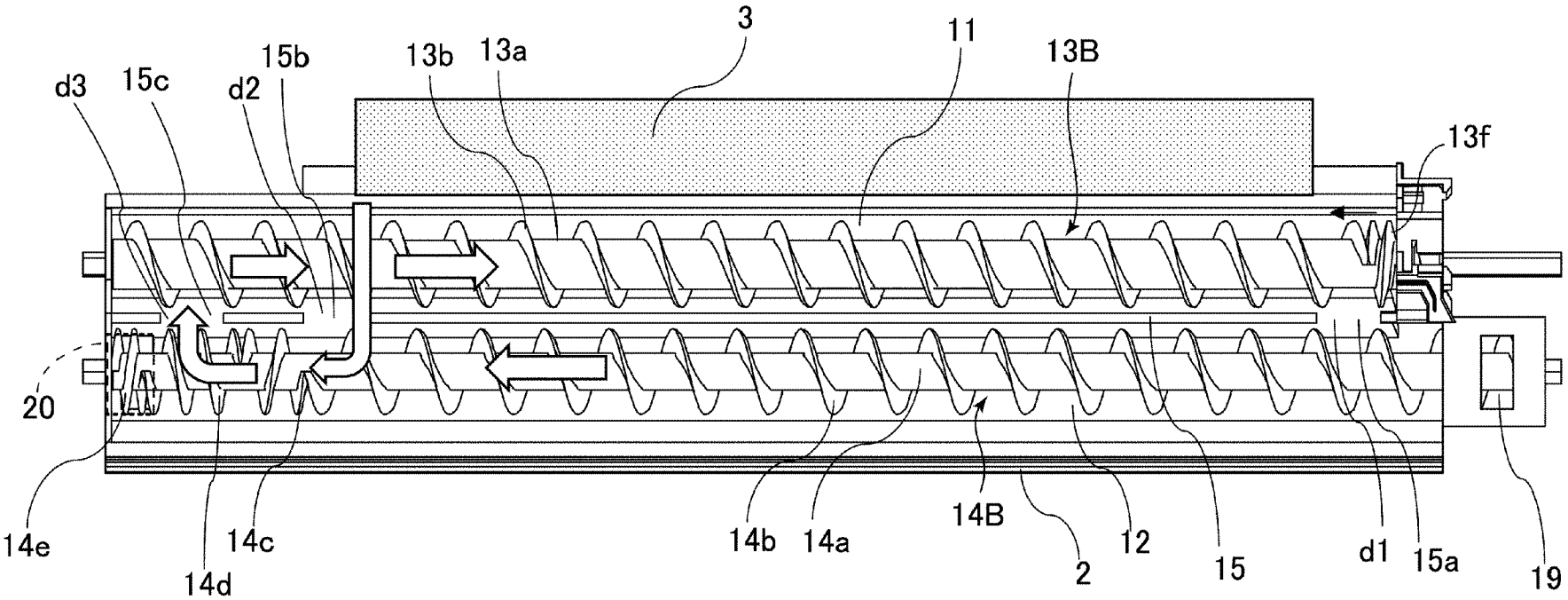

FIG. 14 is a schematic view for illustrating a flow of airflow in the developing device of the third embodiment.

Figure 15:
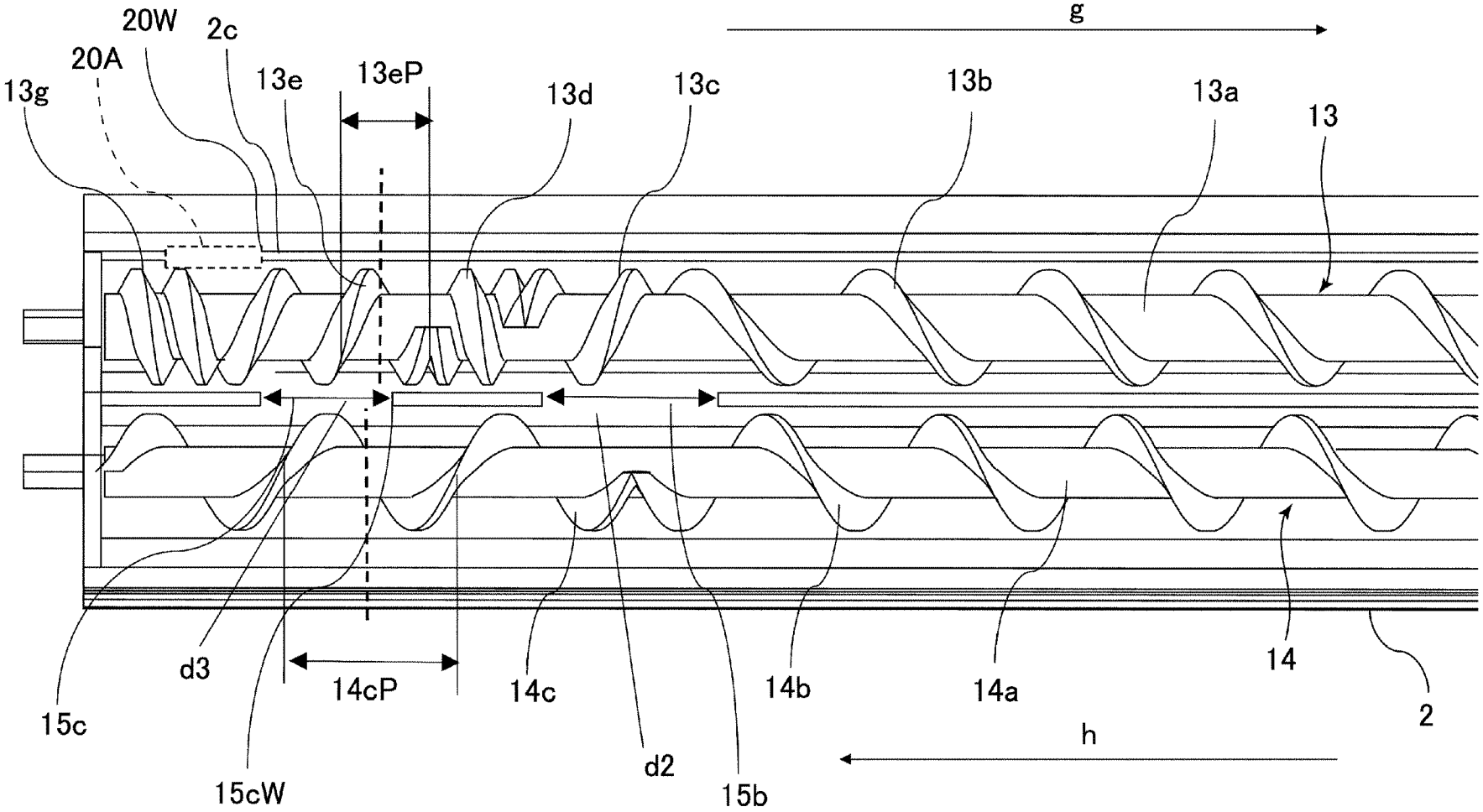

FIG. 15 is a schematic longitudinal sectional view showing a discharge opening-side portion of a developing device according to a fourth embodiment in an enlarged manner.

Figure 16:
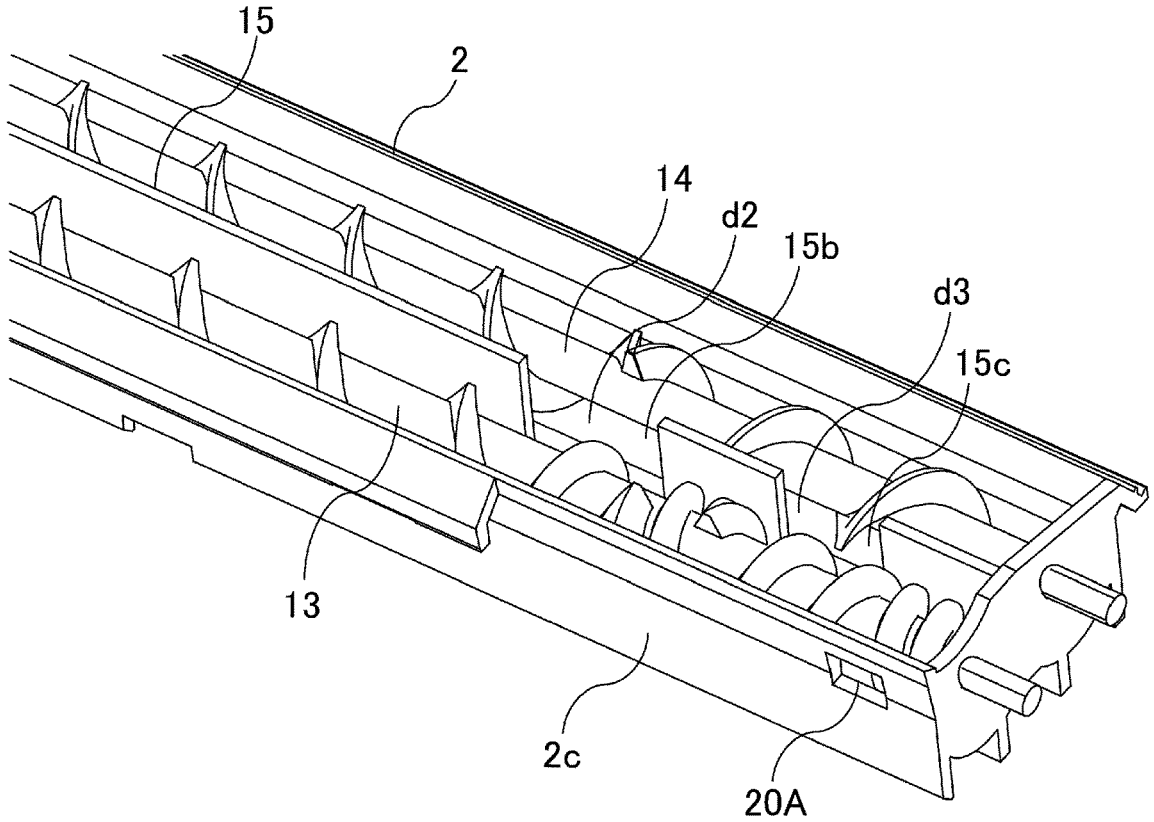

FIG. 16 is a perspective view showing the discharge opening-side portion of the developing device of the fourth embodiment in a partly omitted manner.

Figure 17:
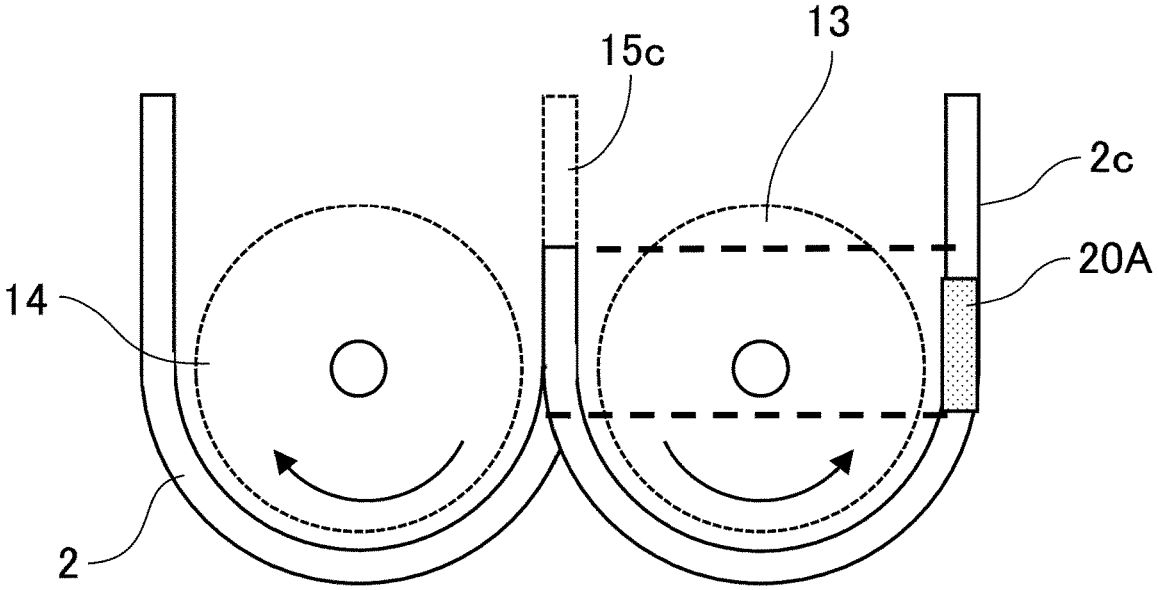

FIG. 17 is a schematic view showing a relationship between a discharge opening and a third opening of the developing device of the fourth embodiment.

DESCRIPTION OF EMBODIMENTS

First Embodiment

A first embodiment will be described with reference to FIGS. 1 to 10. First, a general structure of an image forming apparatus in this embodiment will be described using FIG. 1.

[Image Forming Apparatus]

An image forming apparatus 100 is an electrophotographic full-color printer including four image forming portions PY, PM, PC and PK provided corresponding to four colors of yellow, magenta, cyan and black, respectively. In this embodiment, the image forming apparatus 100 is of a tandem type in which the image forming portions PY, PM, PC and PK are disposed along a rotational direction of an intermediary transfer belt 24 described later. The image forming apparatus 100 forms a toner image (image) on a recording material P depending on an image signal from a host device such as an original reader (not shown) communicatably connected with an image forming apparatus main assembly or a personal computer communicatably connected with the image forming apparatus main assembly. As the recording material 27, it is possible to cite sheet materials such as a sheet, a plastic film and a cloth.

An outline of such an image forming process will be described. First, in the respective image forming portions PY, PM, PC and PK, toner images of the respective colors are formed on photosensitive drums 28Y, 28M, 28C and 28K, respectively. The thus formed color toner images are transferred onto the intermediary transfer belt 24 and then are transferred from the intermediary transfer belt 24 onto the recording material P. The recording material 27 on which the toner images are transferred is fed to a fixing device 25, in which the toner images are fixed on the recording material P. This will be described specifically below. The image forming portions PY, PM, PC and PK are constituted by drum cartridges including the photosensitive drums 28Y, 28M, 28C and 28K and developing devices (developing cartridges) 1Y, 1M, 1C and 1K, respectively, which are detachably mountable to an image forming apparatus main assembly. Each of the image forming portions may be constituted by a process cartridge prepared by integrally assembling the drum cartridge and the developing cartridge into a unit detachably mountable to the image forming apparatus main assembly.

The four image forming portions PY, PM, PC and PK provided in the image forming apparatus 100 have substantially the same except that colors of developers are different from each other. Accordingly, in the following, as a representative, the image forming portion PY will be described, and constituent elements of other image forming portions are represented by replacing a suffix "Y", added to reference numerals or symbols of these in the image forming portion PY, with "M", "C" and "K", respectively, and will be omitted from description.

In the image forming portion PY, as an image bearing member, a cylindrical photosensitive member, i.e., the photosensitive drum 28Y, is provided. The photosensitive drum 28Y is rotationally driven in an arrow direction in FIG. 1 at a predetermined process speed (peripheral speed). At a periphery of the photosensitive drum 28Y, a charging roller 21Y (charging device), a developing device 1Y, a primary transfer roller 23Y and a cleaning device 26Y are provided. Above the photosensitive drum 28Y in the figure, an exposure device (laser scanner) 22Y is provided.

The charging roller 21Y is rotated by the photosensitive drum 28Y during image formation. The charging roller 21Y is urged toward the photosensitive drum 28Y by an urging spring (not shown). Further, to the charging roller 21Y, a charging bias is applied from a high-voltage source. As a result, the photosensitive drum 28Y is electrically charged substantially uniformly by the charging roller 21Y.

Further, the intermediary transfer belt 24 is disposed opposed to the photosensitive drums 28Y, 28M, 28C and 28K. The intermediary transfer belt 24 is stretched by a plurality of stretching rollers including an inner secondary transfer roller 29*a* and is circulated and moved in an arrow direction by drive of a driving roller of the stretching rollers. At a position opposing the inner secondary transfer roller 29*a* through the intermediary transfer belt 24, an outer secondary transfer roller 29*b* as a secondary transfer member is provided, and constitutes a secondary transfer portion T2 where the toner image is transferred from the intermediary transfer belt 24 onto the recording material P. On a side downstream of the secondary transfer portion T2 with respect to a recording material feeding direction, the fixing device 25 is disposed.

A process for forming the image by the image forming apparatus 100 constituted as described above will be described. First, when an image forming operation is started, a surface of the rotating photosensitive drum 28Y is electrically charged uniformly by the charging roller 21Y. Then, the photosensitive drum 28Y is exposed to laser light emitted from the exposure device 22Y and corresponding to an image signal. As a result, an electrostatic latent image corresponding to the image signal is formed on the photosensitive drum 28Y. The electrostatic latent image on the photosensitive drum 28Y is visualized by the toner accommodated in the developing device 1Y and thus is formed in a visible image (toner image).

The toner image formed on the photosensitive drum 28Y is primary-transferred onto the intermediary transfer belt 24 at a primary transfer portion T1Y constituted between the photosensitive drum 28Y and the intermediary transfer belt 24 sandwiched by the primary transfer roller 23Y and the photosensitive drum 28Y. Toner (transfer residual toner) remaining on the surface of the photosensitive drum 28Y after primary transfer is removed by the cleaning device 26Y.

Such an operation is successively performed also in the respective image forming portions for magenta, cyan and black, so that the resultant four color toner images are superposed on the intermediary transfer belt 24. Thereafter, the recording material 27 accommodated in a recording material accommodating cassette (not shown) is fed to the secondary transfer portion T2 in synchronism with timing of toner image formation, and the four color toner images are secondary-transferred together from the intermediary transfer belt 24 onto the recording material 27. Toner remaining on the intermediary transfer belt 24 which cannot be completely transferred at the secondary transfer portion T2 is removed by an intermediary transfer belt cleaner 24*a*.

Then, the recording material 27 is fed to the fixing device 25. By this fixing device 25, the toners (toner images) on the recording material 27 are melted and mixed under application of heat and pressure, and are fixed as a full-color image on the recording material 27. Thereafter, the recording material 27 is discharged to an outside of the image forming apparatus. As a result, a series of image forming processes is ended. Incidentally, by using only desired image forming portion(s), it is also possible to form an image of a desired signal color or images of a desired plurality of colors.

[Developing Device]

Next, the developing device 1Y will be described using FIGS. 2 and 3. Incidentally, also the developing devices 1M, 1C and 1K are similarly constituted. The developing device 1Y includes a developing container 2 accommodating a two-component developer containing a non-magnetic toner and a magnetic carrier. The developing container 2 opens at a portion of a developing region opposing the photosensitive drum 28Y, and a developing sleeve 3 as a developer carrying member in which a magnet roller 4 is non-rotatably provided is provided so as to be partly exposed at an opening of the developing container 2.

Figure 2:
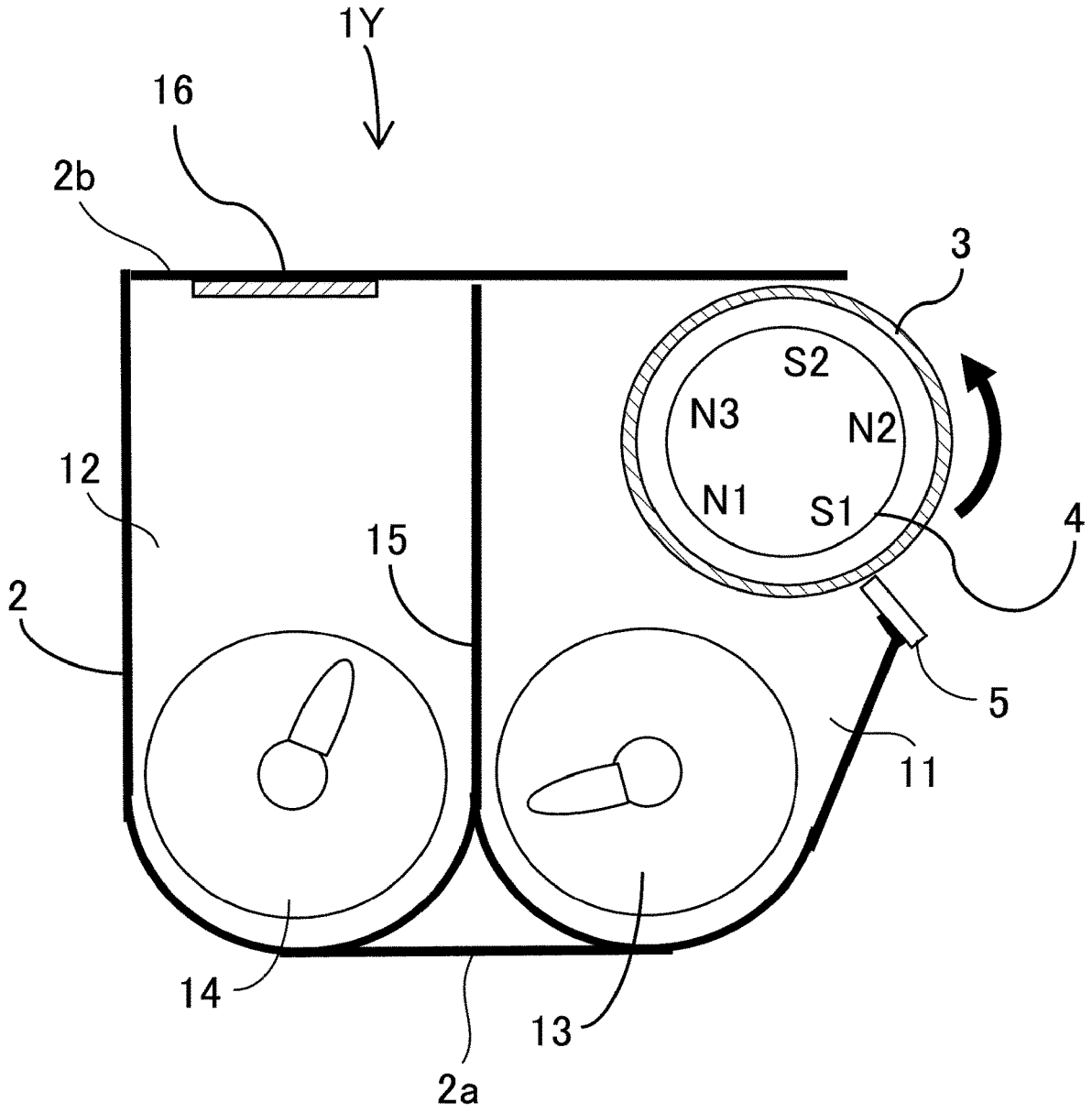
FIG. 2 is a schematic cross-sectional view of a developing device according to the first embodiment.

In this embodiment, the developing sleeve 3 is constituted by a non-magnetic material, and is rotated in an arrow direction in FIG. 2 at a predetermined process speed (peripheral speed). The magnet roller 4 as a magnetic field generating means includes, as a plurality of magnetic poles, five magnetic poles N1, N2, N3, S1 and S2 along a circumferential direction, and by a magnetic field generated by the magnetic roller 4, the developer is carried on the surface of the developing sleeve 3.

That is, the developing sleeve 3 is rotated in an arrow direction in FIG. 2 and feeds the developer, attracted at a position of N1 pole (attraction pole) of the magnet roller 4, in a direction of a blade 5 as a regulating member. The developer erected on the developing sleeve 3 by S1 pole passes through a gap between the developing sleeve 3 and the blade 5 while being regulated in amount thereof, and thus forms a developer layer with a predetermined layer thickness. Then, the developer layer is carried and conveyed to a developing region (developing position) opposing the photosensitive drum 28 and develops the electrostatic latent image formed on the surface of the photosensitive drum 28, in a state in which a magnetic chain thereof is formed by N2 pole. The developer after being subjected to development is conveyed to a non-magnetic region between N3 pole (peeling pole) and the N1 pole, where the developer is peeled off by the developing sleeve 3 and is taken into a developer circulation passage.

Incidentally, in this embodiment, relative to the developing region which is an opposing portion between the photosensitive drum 28Y and the developing sleeve 3, in order to regulate the developer on an upstream side of a rotational direction of the surface of the developing sleeve S, the blade 5 is disposed below the developing sleeve 3.

An inside of the developing container 2 is partitioned into a developing chamber 11 as a first chamber and a stirring chamber 12 as a second chamber by a partition wall (partitioning member) 15 extending in a vertical direction. As shown in FIG. 3, on both sides of the partition wall 15 with respect to a longitudinal direction (rotational axis direction of the developing sleeve 3), a first opening 15*a* as a first communication opening and a second opening 15*b* as a second communication opening which are used for establishing communication between the developing chamber 11 and the stirring chamber 12 are provided, respectively. The first opening 15*a* permits communication of the developer from the developing chamber 11 to the stirring chamber 12. The second opening 15*b* permits communication of the developer from the stirring chamber 12 to the developing chamber 11. By this, the circulation passage of the developer is formed by the developing chamber 11 and the stirring chamber 12. Incidentally, in the case of this embodiment, although the partition wall 15 is provided with a third opening 15*c* as a third communication opening, the third opening 15*c* will be described later.

Further, in the developing container 2, a supplying screw 13 as a first feeding screw and a stirring screw 14 as a second feeding screw which are used for feeding the developer while stirring the developer are provided.

The supplying screw 13 is disposed in the developing chamber 11, and not only feeds the developer from the developing chamber 11 (first chamber) in a first direction (arrow g direction of FIG. 3) from the second opening 15*b* toward the first opening 15*a* while stirring the developer, but also supplies the developer to the developing sleeve 3. The stirring screw 14 is disposed in the stirring chamber 12 and feeds the developer from the stirring chamber 12 (second chamber) in a second direction (arrow h direction of FIG. 3) from the first opening 15*a* toward the second opening 15*b* while stirring the developer. The second direction is a direction opposite to the first direction. Thus, the developer is fed by the supplying screw 13 and the stirring screw 14 and is circulated through the first opening 15*a* and the second opening 15*b*.

In the developing device 1, a two-component developer is used, and therefore, depending on toner consumption in the developing device 1, the developer is appropriately supplied into the developing device 1 through a supply opening 19 (FIG. 3) provided at a part of the developing device 1. Specifically, on a side upstream of the stirring chamber 12 with respect to a feeding direction (second direction) of the stirring screw 14 in the stirring chamber 12, a supplying feeding passage 19*a* is connected. The supplying feeding passage 19*a* is used for supplying a developer for supply into the circulation passage and is provided with the supply opening 19. The supplying feeding passage 19*a* is connected to a supply feeding portion (supplying pipe) of an unshown developer supplying device through the supply opening 19. In the supplying feeding passage 19*a*, the stirring screw 14 is extended, so that the developer supplied through the supply opening 19 is fed into the circulation passage by the stirring screw 14.

Then, the supplied developer is stirred and mixed with the developer in the developing device 1Y while being fed by the stirring screw 14 and the supplying screw 13. Thus, a part of the developer stirred and mixed by the stirring screw 14 and the supplying screw 13 is supplied to the surface of the developing sleeve 13 and is carried on the surface of the developing sleeve 13.

In this embodiment as a development type, the two-component development type is used and the developer, a mixture of a negatively chargeable non-magnetic toner and a positively chargeable magnetic carrier is used. The non-magnetic toner is obtained by adding from powder of titanium oxide, silica or the like to a surface of powder prepared by incorporating a colorant, a wax component and the like into a resin material such as polyester or styrene-acrylic resin and then by subjecting a resultant mixture to pulverization or polymerization. The magnetic carrier is obtained by subjected, to resin coating, a surface layer of a core formed with ferrite particles or resin particles kneaded with magnetic powder. The content (weight ratio of the toner to the developer) of the toner in the developer in an initial state is 10% in this embodiment.

In general, in the two-component development type using the toner and the carrier, the toner and the carrier are triboelectrically contacted to each other and are charged to predetermined polarities. For this reason, the two-component development type has a feature such that stress exerted on the toner is less than a one-component development type using a one-component developer.

Further, a surface area of the carrier in the developer is larger than a surface area of the toner, so that in an initial stage of use, the carrier is less contaminated with the toner by deposition of the toner on the carrier surface. However, by long-term use, a contaminant (spent toner) deposited on the carrier surface increases, and for that reason, toner charging ability gradually lowers. As a result, problems such as a fog and toner scattering occur. In order to realize lifetime extension of the developing device of the two-component development type, it would be considered that an amount of the carrier accommodated in the developing device is increased, but this invites upsizing of the developing device and therefore is undesirable.

For that reason, in the developing device 1Y in this embodiment, an ACR (auto carrier refresh) type is employed. In the ACR type, as described above, not only a new developer is supplied little by little into the developing container 2 but also a developer deteriorated in charging performance is discharged little by little from the developing device. Such a developing device 1Y has a constitution in which an excessive deteriorated developer is discharged by utilizing a volume fluctuation of the developer and thus a volume level of the developer in the developing container 2 is maintained substantially constant. According to the developing device 1Y of this ACR type, the deteriorated carrier in the developing container 2 is replaced little by little with a new (fresh) carrier, so that a charging performance of the carrier in the developing container 2 can be maintained substantially constant. For the developing device 1Y of the above-described ACR type, a developer for supply high in toner ratio is used. In general, a weight ratio of the carrier to the toner is about 5-10%. In other words, as the developer for supply, a developer with a toner concentration (content) of 90% or more, for example, about 90-95% (90% or more and 95% or less) is used.

Incidentally, as shown in FIG. 2, a top plate portion 2*b* covering an upper portion of the stirring chamber 12 of the developing container 2 is provided with an air-discharging opening through which airflow is capable of being discharged from an inside to an outside of the stirring chamber 12. In this embodiment, the top plate portion 2*b* is disposed so as to cover the upper portion of the developing chamber 11 and the stirring chamber 12, and the air-discharging opening 16 is formed above the supplying screw 14 disposed in the stirring chamber 12.

Figure 3:
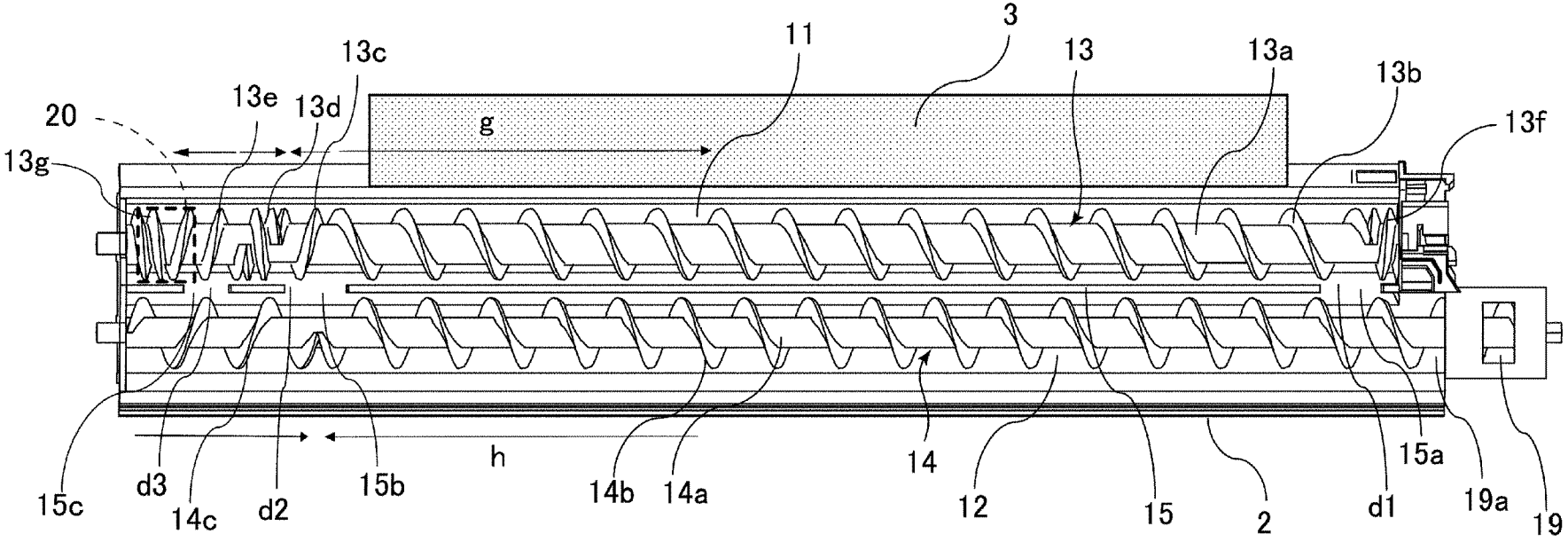
FIG. 3 is a schematic longitudinal sectional view of the developing device of the first embodiment.

The developing device 1Y will be specifically described using FIG. 3. In FIG. 3, each arrow represents a flow of the developer fed by rotation of the feeding screws 13 and 14. As described above, the developing device 1Y is provided in the developing container 2 with two accommodating chambers which are consisting of the developing chamber 11 and the stirring chamber 12 and in which the developer is accommodated. Between these two accommodating chambers is a partition wall 15. Further, the developing chamber 11 is provided with the supplying screw 13 and the stirring chamber 12 is provided with the stirring screw 14.

The supplying screw 13 and the stirring screw 14 are extended in a bar shape and are disposed horizontally and in parallel to each other. The supplying screw 13 includes a rotation shaft (first rotation shaft) 13*a* circular in cross-section and a helical blade 13*b* as a first blade provided helically around the rotation shaft 13*a* along a rotational axis direction. Further, also, the stirring screw 14 includes, similarly as the supplying screw 13, a rotation shaft (second rotation shaft) 14*a* circular in cross section and a helical blade 14*b* provided helically around the rotation shaft 14*a* along a rotational axis direction. Each of the supplying screw 13 and the stirring screw 14 is provided with another helical blade other than the helical blades 13*b* and 14*b*, but these will be described later.

The helical blade 13*b* of the supplying screw 13 and the helical blade 14*b* of the stirring screw 14 are the helical blades rotatable in directions opposite to each other, and when the supplying screw 13 and the stirring screw 14 are rotated, the developers in the developing chamber 11 and the stirring chamber 12 are fed in directions opposite to each other while being stirred. That is, the developer in the developing chamber 11 in which the supplying screw 13 is disposed is fed in an arrow g direction along the supplying screw 13, and the developer in the stirring chamber 12 in which the stirring screw 14 is disposed is fed in an arrow h direction along the stirring screw 14.

On the other hand, the partition wall 15 partitioning the developing chamber 11 and the stirring chamber 12 is provided at opposite end portions thereof with a first opening 15*a* and a second opening 15*b* connecting the first developing chamber 11 and the stirring chamber 12. For this reason, the developer in the developing chamber 11 fed in the arrow g direction passes through the first opening 15*a* and flows into the stirring chamber 12, and the developer in the stirring chamber 12 fed in the arrow h direction passes through the second opening 15*b* and flows into the developing chamber 11. Thus, the developer in the developing device 1 is circulated and moved while being stirred in the developing chamber 11 and the stirring chamber 12. Incidentally, each of regions d1 and d2 shown in FIG. 3 is an opening region of each of the first opening 15*a* and the second opening 15*b*, respectively, provided in the partition wall 5 partitioning between the developing chamber 11 and the stirring chamber 12.

Further, the developing device 1Y includes the developing sleeve 3 in a position adjacent to the developing chamber 11 in which the supplying screw 13 is disposed. A part of the developing sleeve 3 is exposed from the developing container 2. Further, the developing device 1Y is disposed inside the image forming apparatus 100 (see FIG. 1) so that the exposed portion of the developing sleeve 3 comes close to the photosensitive drum 28Y.

The developing sleeve 3 rotates in an arrow direction of FIG. 2 while the developer in the developing chamber 11 is disposed on a surface thereof by a magnetic force, and feeds the developer to a position (developing position) opposing the photosensitive drum 28Y. Then, the electrostatic latent image formed on the surface of the photosensitive drum 28Y is developed with the toner in the developer, so that the toner image is formed on the surface of the photosensitive drum 28Y. On the other hand, the developer disposed on the surface of the developing sleeve 3 after the development is returned into the developing container 2 with the rotation of the developing sleeve 3 and is separated from the developing sleeve 3, so that the provided is stirred together with another developer in the developing chamber 11 while being circulated and moved.

Figure 1:
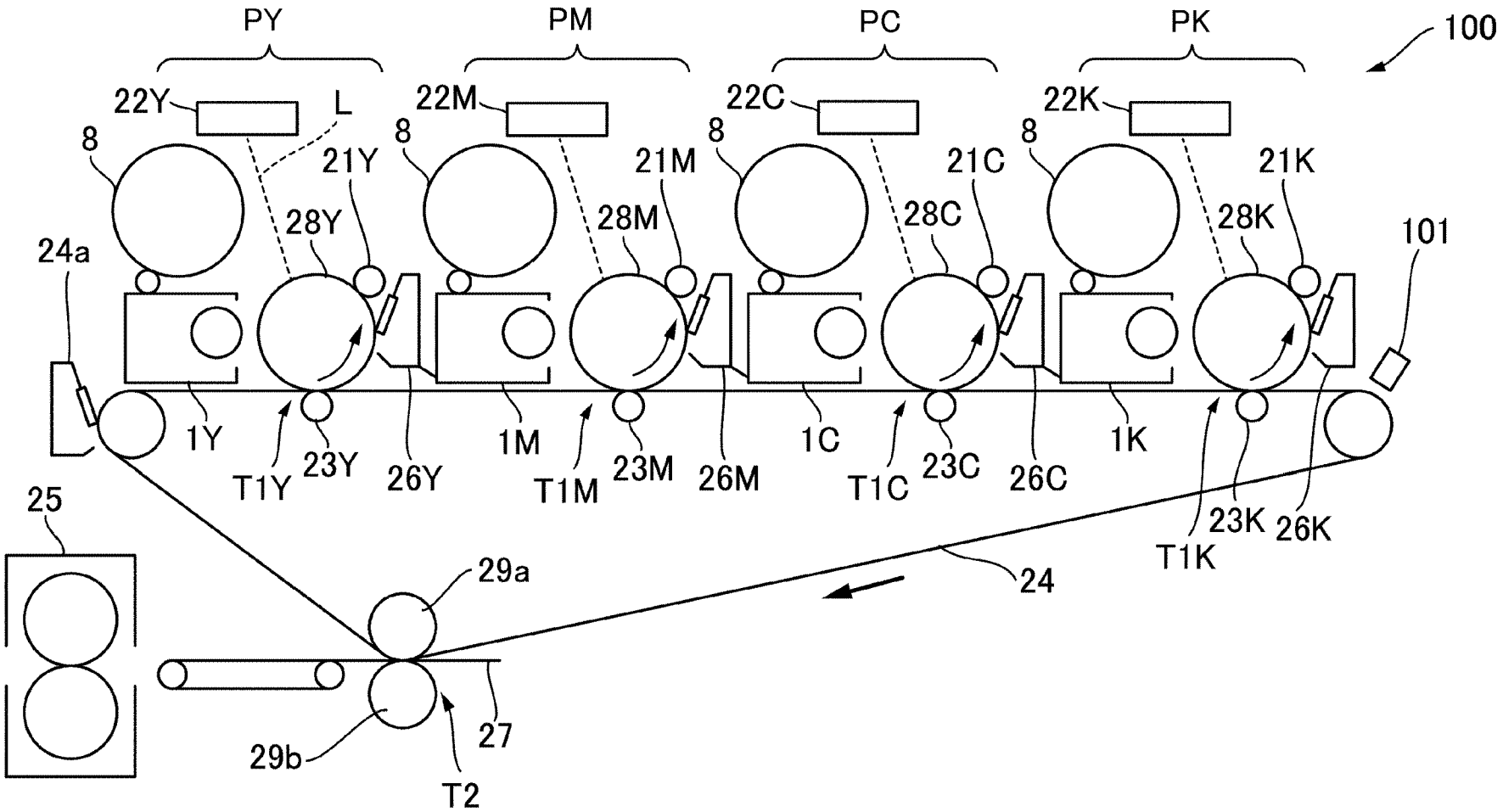
FIG. 1 is a schematic view of an image forming apparatus in a first embodiment.

When the development with the toner as described above is repeated, the amount of the toner in the developer in the developing container 2 decreases. Therefore, this developing container 2 is provided with the supply opening 19 through which the developer containing toner is supplied. Further, the developer in the developer accommodating container 8 shown in FIG. 1 is supplied into the developing device 1 through the supply opening 19 by the developer supplying device. The supply opening 19 is provided on a further upstream side (side opposite to the arrow h direction) of the first opening 15*a* of the stirring chamber 12 in which the stirring screw 14 is disposed. The stirring screw 14 extends to a position where the supply opening 19 is formed, so that the developer supplied through the supply opening 19 is fed toward a downstream side (direction indicated by the arrow h) in the stirring chamber 12. Then, the developer is merged with the developer flowed into the stirring chamber 12 through the first opening 15*a* and is fed to a further downstream side (direction indicated by the arrow h) in the stirring chamber 12.

A bottom plate portion 2*a* (lower surface of developing container 2, see FIG. 2) of the developing container 2 is provided with a discharge opening 20 through which the developer in the developing container 2 is discharged little by little, so as to open downward. The developer in the developing device 1 is discharged little by little through the discharge opening 20, whereby excessive progress of deterioration of the developer due to the stirring and the feeding is suppressed. Through the discharge opening 20, not only the toner but also the carrier are discharged together. For this reason, in the developer supplied through the supply opening 19, in addition to the toner, the carrier in a small amount which compensates for a decrease in amount of the carrier is also contained.

The discharge opening 20 through which the developer in the developing container 2 is discharged little by little as described above is disposed in a position indicated by a broken line in FIG. 3, and opens downward. That is, with respect to the feeding direction (arrow g direction) of the developer in the developing chamber 11 in which supplying screw 13 is disposed, the discharge opening 20 is provided in a position on a further upstream side than the second opening 15*b* through which the developer in the stirring chamber 12 flows into the developing chamber 11. Most of the developer flowing into the developing chamber 11 through the second opening 15*b* is fed toward the downstream side (arrow g direction), but a part of the developer moves toward the upstream side (direction opposite to the arrow g direction), i.e., moves toward the discharge opening 20 side, and is discharged to the outside of the developing device 1Y through the discharge opening 20. The developer discharged to the outside of the developing device 1Y through the discharge opening 20 passes through an unshown collecting toner discharging passage and is accommodated in an unshown collecting toner tank.

[Structure of Each Screw]

Next, a structure of each of the screws of the developing device 1Y will be described. First, the stirring screw 14 is a screw for feeding the developer in the stirring chamber 13 in the arrow h direction. That is, the stirring screw 14 is provided with the helical blade 14*b* around the rotation shaft 14*a*, and when this stirring screw 14 is rotated, the developer is fed in the arrow h direction (second direction) by the helical blade 14*b*. The stirring screw 14 extends to the supply opening 19, and then is fed together with the developer supplied through the supply opening 19, in the arrow h direction.

Further, on a downstream side of the arrow h direction of the stirring screw 14, another helical blade 14*c* rotatable in a direction opposite to the direction of the helical blade 14*b* is provided. The developer fed in the arrow h direction by being fed (pushed) by the helical blade 14*b* of the stirring screw 14 is pushed back by the helical blade 14*c* rotated in the opposite direction when the developer further moves downstream than the second opening 15*b*. The helical blade 14*c* is disposed in a helical shape around the rotation shaft 14*a* so as to feed the developer in the direction opposite to the arrow h direction. That is, the stirring screw 14 includes a third portion where the stirring screw 14 feeds the developer in the arrow h direction (second direction) and a fourth portion which is disposed on a side downstream of the third portion with respect to the arrow h direction (second direction) and where the stirring screw 14 feeds the developer, fed to the side downstream of the second opening 15*b* with respect to the arrow h direction, in a direction opposite to the arrow h direction. In the third portion and the fourth portion, the helical blade 14*b* and the helical blade 14*c* are disposed, respectively. For this reason, the developer fed to the second opening 15*b* in the arrow h direction passes through the second opening 15*b* and is delivered to the developing chamber 11. Incidentally, the fourth portion is extended to a region, with respect to the arrow h direction, where the third opening 15*c* described later is present.

Next, a structure of the supplying screw 13 will be described. Basically, the supplying screw 13 feeds the developer, which passes through the second opening 15*b* provided in the region d2 and then flows into the developing chamber 11, the first opening 15*a* provided in the region d1 in the arrow g direction. Further, the supplying screw 13 performs a function of delivering the fed developer to the stirring chamber 13 through the first opening 15*a*.

The supplying screw 13 is provided on the downstream side of the helical blade 13*b* with a helical blade 13*f* rotatable in a direction opposite to the direction of the helical blade 13*b*. The helical blade 13*f* is disposed in a helical shape around the rotation shaft 13*a* so as to feed the developer in a direction opposite to the arrow g direction. A boundary between both the helical blade 13*b* and the helical blade 13*f* is positioned in the region d1 where the first opening 15*a* is provided. For this reason, the developer fed in the arrow g direction is prevented from further advancing by the helical blade 13*f*, and passes through the first opening 15*a* and flows into the stirring chamber 12.

Further, the supplying screw 13 is provided with a short helical blade 13*c* positioned on a side upstream of the helical blade 13*b* with respect to the developer feeding direction (first direction) indicated by the arrow g and positioned in the region d2 of the second opening 15*b* through which the developer is received from the stirring chamber 12 in which the stirring screw 14 is speeded. This helical blade 13*c* is rotated in the direction opposite to the direction of the helical blade 13*b* and performs a function of pushing a part of the developer, passed through the second opening 15*b*, toward the upstream side in the direction opposite to the arrow g direction.

Further, the supplying screw 13 is provided with another helical blade 13*d* on a side (side of the direction opposite to the arrow g direction) further upstream of the helical blade 13 which is disposed in the region d2 of the above-described second opening 15*b* and which is positioned in the opposite direction. Compared with the helical blade 13*b* which performs the feeding of the developer in the arrow g direction, the helical blade 13*d* is a helical blade having the same direction of rotation.

Here, the helical blade 13*c* disposed in the region d2 of the second opening 15*b* pushes a part of the developer, toward the upstream side (the helical blade 13*d* side), which passes through the second opening 15*b* and which flows into the developing chamber 11. On the other hand, the helical blade 13*d* disposed upstream of the helical blade 13*c* is a helical blade rotated in the same direction as the helical blade 13*b* which feeds the developer in the arrow g direction, and therefore, the developer pushed toward the upstream side by the helical blade 13*c* is pushed back by the helical blade 13*d*. Further, a part of the developer in a region of the helical blades 13*c* and 13*d* moves toward a further upstream side against an obstacle by the helical blade 13*d* such that the developer is pushed back toward the downstream side.

Further, the supplying screw is provided with another helical blade 13*e* on a side further upstream of the helical blade 13*d*. This helical blade 13*e* is a helical blade having a function such that the developer moved to the upstream side by overcoming the obstacle that the developer is pushed back toward the downstream side by the helical blade 13*d* is fed toward a further upstream side (in the direction opposite to the arrow g direction) to the discharge opening 20.

That is, the supplying screw 13 includes a first portion for feeding the developer in the arrow g direction (first direction) and a second portion disposed on a side upstream of the first portion with respect to the arrow g direction (first direction) and for feeding a part of the developer, flowing into the developing chamber 11 through the second opening 15*b*, in the direction opposite to the arrow g direction. Further, the first portion is provided with the helical blade 13*b* as a first blade disposed helically around the rotation shaft 13*a* so as to feed the developer in the arrow g direction. Further, the second portion is provided with the helical blades 13*c*, 13*d* and 13*e* as a second blade, a third blade, and a fourth blade, respectively.

The helical blade 13*c* as the second blade is disposed helically around the rotation shaft 13*a* so as to feed the developer in the direction. The helical blade 13*d* as the third blade is disposed on the side upstream of the helical blade 13*c* in the second portion with respect to the arrow g direction and is provided helically around the rotation shaft 13*a* so as to feed the developer in the arrow g direction. The helical blade 13*e* as the fourth blade is disposed on the side upstream of the helical blade 13*d* in the second portion with respect to the arrow g direction and is provided helically around the rotation shaft 13*a* so as to feed the developer, getting over the helical blade 13*d*, in the direction opposite to the arrow g direction toward the discharge opening 20.

Further, on a most upstream side of the supplying screw 13 with respect to the arrow g direction, a helical blade 13*g* which performs a function of feeding the developer, which is not satisfactorily discharged through the discharge opening 20 although passes through the discharge opening 20 by being fed by the helical blade 13*e*, toward the downstream side with respect to the arrow g direction (first direction) so as to be pushed back toward the discharge opening 20 side. That is, the helical blade 13*b* is provided helically around the rotation shaft 13*a* so as to feed the developer in the arrow g direction.

Here, as regards an amount of the developer discharged through the discharge opening 20, by employing the above-described constitution, the developer is discharged little by little when the amount of the developer in the developing device 1Y is large. However, the developer discharged through the discharge opening 20 includes the developer fed to the discharge opening 20 by rotation of the supplying screw 13 and the developer carried to the discharge opening 20 by airflow (air current) flowing in the developing device 1Y.

The airflow flowing in the developing device 1Y is principally the airflow drawn from the outside of the developing device 1Y by rotation of the developing sleeve 3, the supplying screw 13, and the stirring screw 14. Then, the developer raised by a rotational operation of the supplying screw 13 and the stirring screw 14 and a part of the developer peeled off from the above-described non-magnetic force developing (FIG. 2) of the developing sleeve 3 flow into the developing device 1Y in mixture with the airflow.

Particularly, in a constitution in which the discharge opening 20 is positioned on the developing chamber 11 side which is the supplying screw 13 side, i.e., a side close to the developing sleeve 3, the influence of the airflow drawn (sucked) by rotation of the developing sleeve 3 and the supplying screw 13 on the discharge amount of the developer through the discharge opening 20 is large. Especially, in the case where a process speed itself of the image forming apparatus 100 is fast when rotational speeds of the developing sleeve 3, the supplying screw 13, and the stirring screw 14 are fast, the amount of the airflow drawn from the outside of the developing device 1Y also become large, so that the amount of the developer flowing in the developing device 1Y in mixture with the airflow.

[Air Flow in Developing Device]

Figure 4:
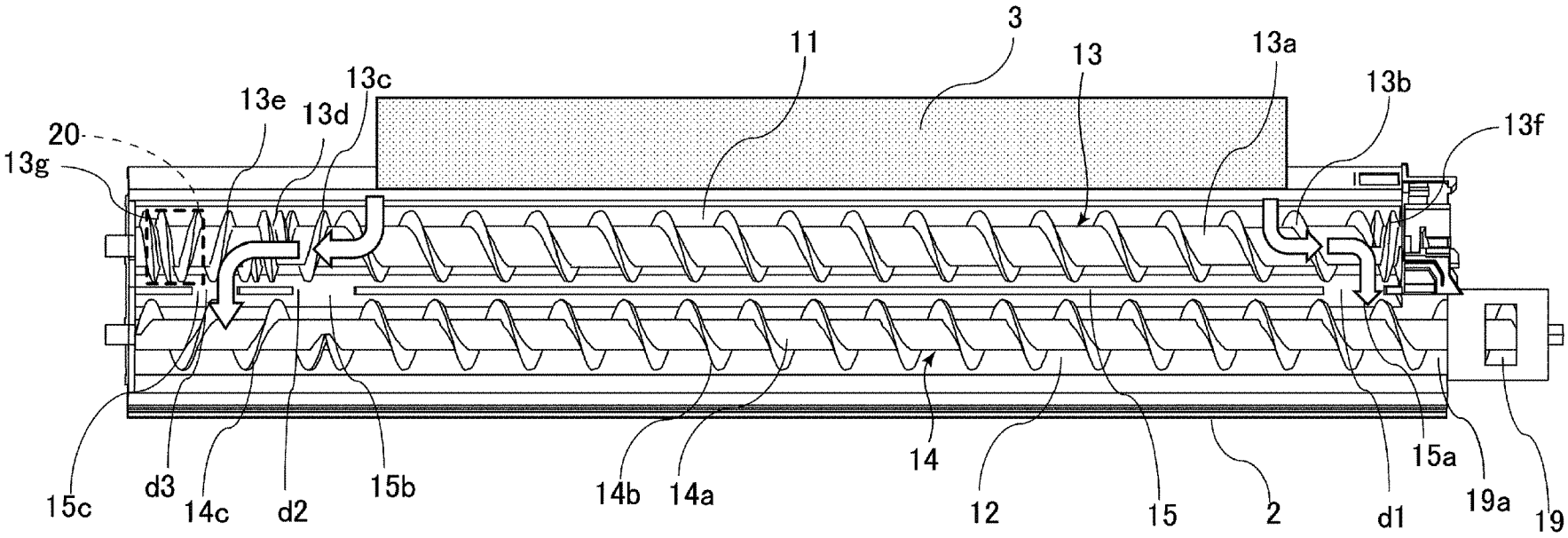
FIG. 4 is a schematic view for illustrating a flow of airflow in the developing device of the first embodiment.

Here, the airflow in the developing device 1Y will be described using FIG. 4. In the neighborhood of the supplying screw 13 in the developing device 1Y, airflows as indicated by arrows flow from the outside as shown in FIG. 4 by rotation of the developing sleeve 3 and the supplying screw 13. Although details will be omitted, then, this airflow flows from the supplying screw 13 toward the stirring screw 14. In the developing device 1Y, the air-discharging opening 16 (see FIG. 2) is disposed at an upper portion of the stirring screw 14, so that the airflow flowing toward the stirring screw 14 side passes through the air-discharging opening 16 toward the outside of the developing device 1Y. The air-discharging opening 16 performs a function of discharging the arrow from the inside to the outside of the developing device 1Y, and at the air-discharging opening 16, a collecting member such as a filter is provided so as to prevent the developer in the developing device 1Y from moving to the outside of the developing device 1Y. However, the air-discharging opening 16 is not necessarily required to be provided with the collecting member.

Next, a flow of the airflow toward the upstream side of the supplying screw 13 will be described. In the second opening 15*b* formed in the partition wall 15, the provided is delivered from the stirring screw 14 side to the supplying screw 13 side, and therefore, a height of a developer surface of the developer in the region d2 becomes high itself. For this reason, in the region d2, not only a space is occupied by the developer but also the developer is fed from the stirring screw 14 side to the supplying screw 13 side, and therefore, the airflow does not readily flow from the supplying screw 13 side into the stirring screw 14, so that most of the airflow flows toward a further upstream side of the supplying screw 13 with respect to the feeding direction (arrow g direction of FIG. 3) as it is.

[Third Opening]

For this reason, in this embodiment, the partition wall 15 is provided with the third opening 15*c* as the third communication portion, and d3 represents a region in which the third opening 15*c* is provided. That is, the third opening 15*c* is provided upstream of the second opening 15*b* of the partition wall 15 with respect to the arrow g direction and permits communication of the airflow between the developing chamber 11 and the stirring chamber 12. Further, with respect to the arrow g direction, a downstream end of the third opening 15*c* is positioned downstream of a downstream end of the discharge opening 20. Further, an opening area of the third opening 15*c* is larger than an opening area of the discharge opening 20.

That is, the third opening 15*c* is disposed on the downstream side of the supplying screw 13 relative to the discharge opening 20 with respect to the arrow g direction, so that the airflow which does not flow from the supplying screw 13 to the stirring screw 14 in the region d2 is sent from the supplying screw 13 to the stirring screw 14 in the region d3. At this time, the helical blade 14*c* on the stirring screw 14 side is rotated in the direction in which the developer is fed from the region d3 to the region d2 as shown in FIGS. 3 and 4, and functions so as to draw the airflow from the supplying screw 13 side toward the stirring screw 14 side in the region d3 by rotation of the helical blade 14*c*.

Figure 5:
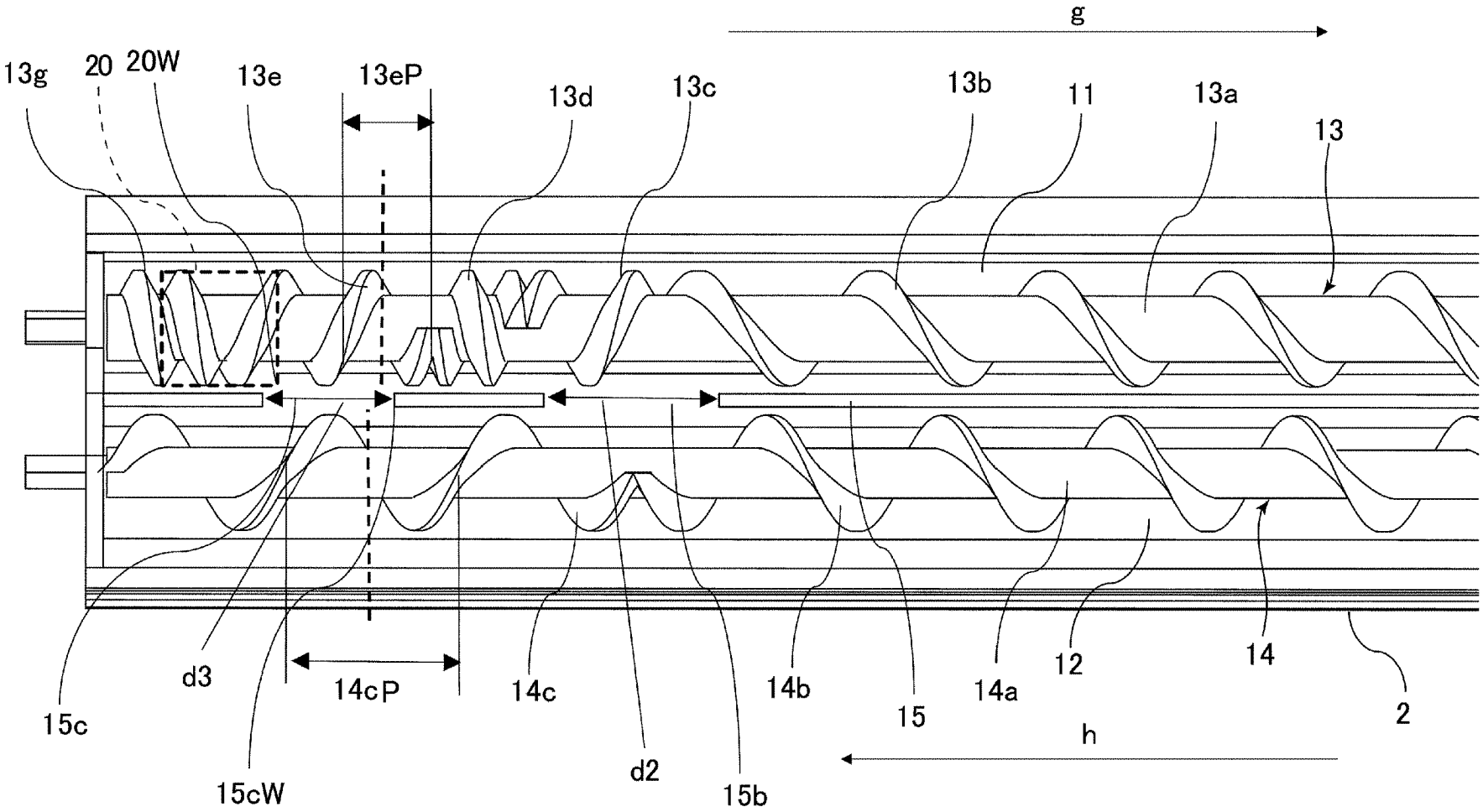
FIG. 5 is a schematic longitudinal sectional view showing a discharge opening-side portion of the developing device of the first embodiment in an enlarged manner.
Figure 6:
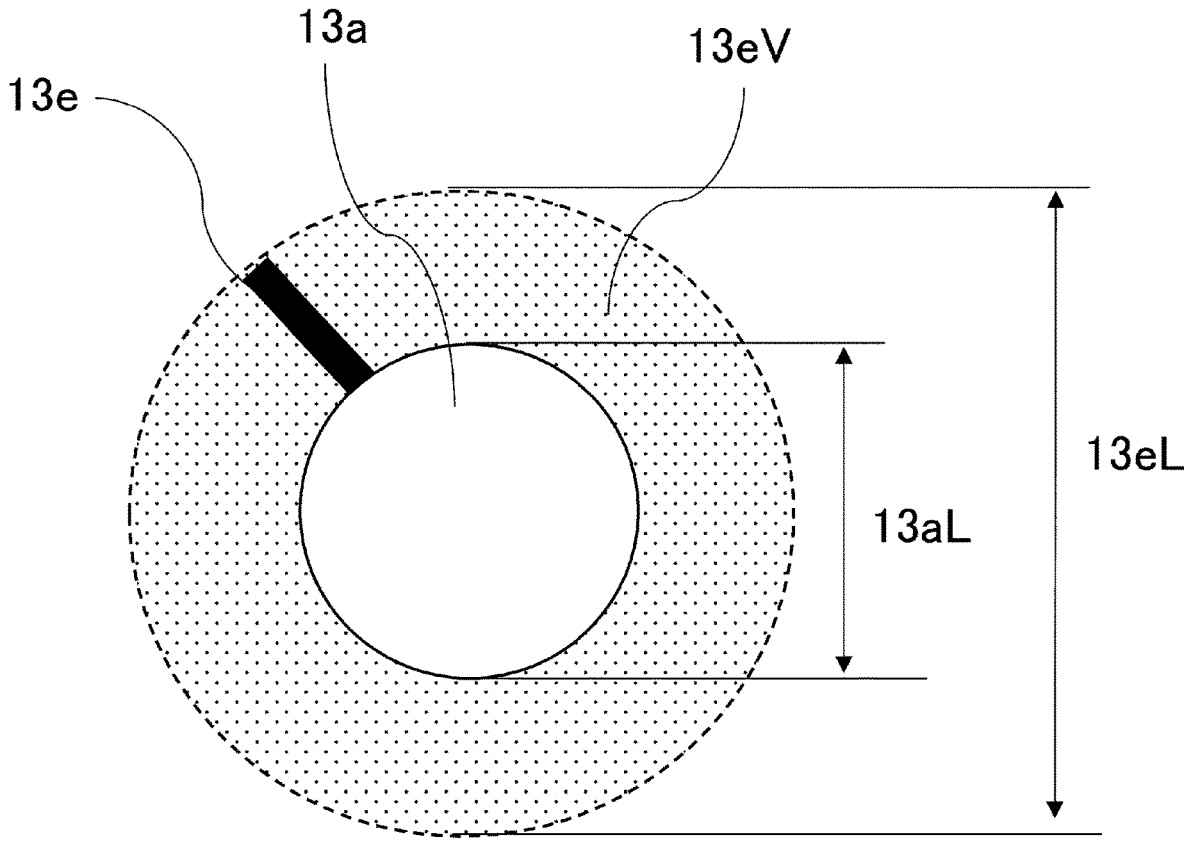
FIG. 6 is a schematic view showing a supplying screw cut in a direction perpendicular to a rotational axis direction in a region of a third opening.
Figure 7:
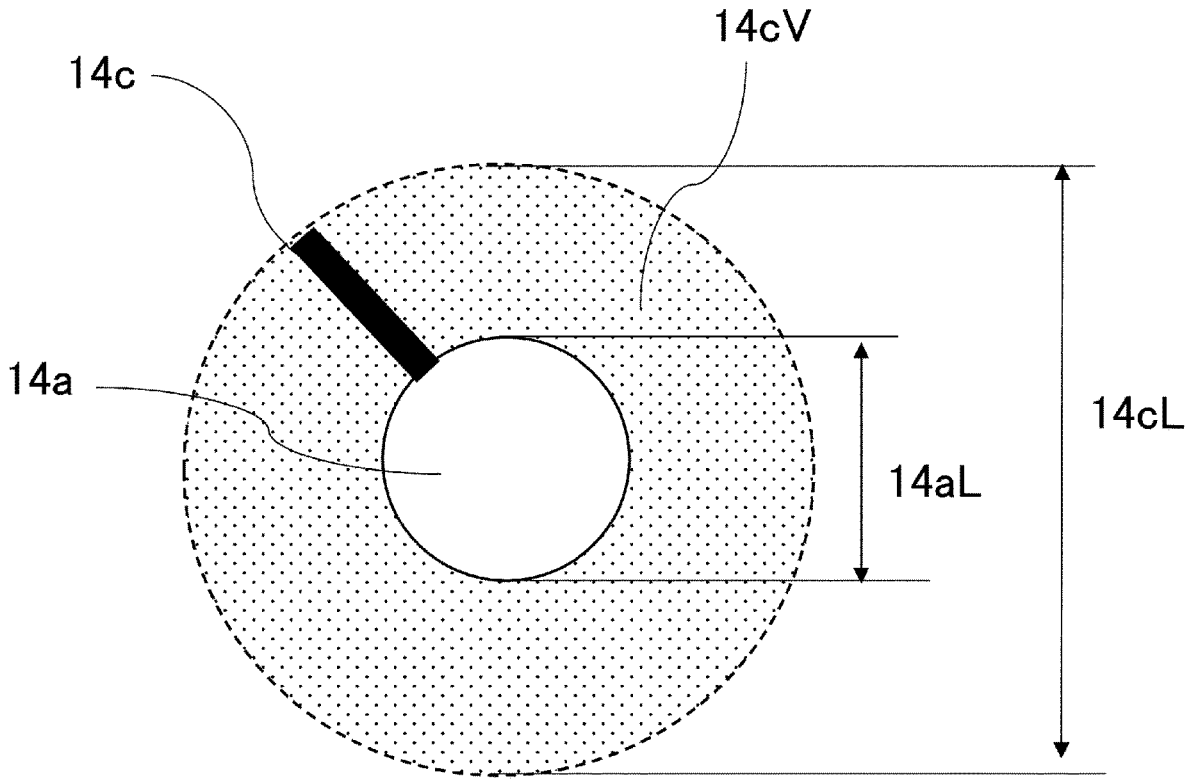
FIG. 7 is a schematic view showing a feeding screw cut in a direction perpendicular to a rotational axis direction in the region of the third opening.

In the following, the airflow drawn from the supplying screw 13 side to the stirring screw 14 side will be specifically described. FIG. 5 is a schematic enlarged view of the neighborhood of the region d2 and the region d3 in FIGS. 3 and 4. FIGS. 6 and 7 are sectional views of the supplying screw 13 and the stirring screw 14, respectively, cut along a direction perpendicular to a longitudinal direction in the region d3.

First, between the helical blade 13*e* of the supplying screw 13 and the helical blade 14*c* of the stirring screw 14, volumes of regions where the rotating helical blade 13*e* and the rotating helical blade 14*c* pass, i.e., volumes of spaces through which these helical blades pass are compared with each other. Incidentally, the helical blade 13*e* corresponds to a first chamber-side blade provided helically around the rotation shaft 13*a* so as to feed the developer toward the discharge opening 20 in a region where the third opening 15*c* exists with respect to the arrow g direction. Further, the helical blade 14*c* corresponds to a second chamber-side blade provided helically around the rotation shaft 14*a* so as to feed the developer in a region where the third opening 15*c* exists with respect to the arrow h direction.

As shown in FIGS. 5 and 6, when a pitch per (one) rotation of the helical blade 13*e* is 13*e*P, a diameter of the helical blade 13*e* is 13*e*L, and a diameter of the rotation shaft 13*a* of the supplying screw 13 is 13*a*L, a volume 13*e*V in which the helical blade 13*e* passes when rotated one full turn is represented by the following formula (1).

$$13eV=\pi\times((13eL/2)^2-(13aL/2)^2)\times 13eP \quad (1)$$

Further, similarly, as shown in FIGS. 5 and 7, when a pitch per (one) rotation of the helical blade 14*e* is 14*c*P, a diameter of the helical blade 14*c* is 14*c*L, and a diameter of the rotation shaft 14*a* of the stirring screw 14 is 14*a*L, a volume 14*c*V in which the helical blade 14*c* passes when rotated one full turn is represented by the following formula (1).

$$14cV=\pi\times((14cL/2)^2-(14aL/2)^2)\times 14cP \quad (2)$$

As described above, 13*e*V and 14*c*V in the formulas (1) and (2) represent the volumes of the spaces in which the helical blades 13*e* and 14*c* pass when the supplying screw 13 and the stirring screw 14 are rotated one full turn (rotation), respectively. Each of these volumes corresponds to a volume of the airflow drawn from a region other than the helical blade (13*e* or 14*c*) when the helical blade (13*e* or 14*c*) is rotated. That is, with an increasing volume of the space in which the helical blade passes when rotated one full turn, the airflow drawn by the helical blade becomes larger.

In this embodiment, in the region d3, 13*e*V of the formula (1) and 14*c*V of the formula (2) satisfy the following formula (relationship) (3).

$$14cV\geq 13eV \quad (3)$$

The formula (3) represents that in the region d3, the airflow flows from the supplying screw 13 side toward the stirring screw 14 side. Particularly, in this embodiment, it is preferable that a region through which the helical blade 14*c* passes per unit time by rotation of the rotation shaft 14*a* is made larger than a region through which the helical blade 13*e* passes per unit time by rotation of the rotation shaft 13*a*. That is, the following relationship may preferably be satisfied.

$$14cV\geq 13eV$$

Incidentally, in the above-described embodiment, a constitution in which each of the supplying screw 13 and the stirring screw 14 is a single-thread screw having a single-thread blade was described, but each of the supplying screw 13 and the stirring screw 14 may also be a multi-thread screw having a plurality of blades (multi-thread blade). The number of threads of the multi-thread screw is defined as 13*e*M for the helical blade 13*e* and is defined as 14*c*M for the helical blade 14*c*, and in addition, the case where the number of rotations (turns) per unit time of the supplying screw 13 and the number of rotations per unit time of the stirring screw 14 are different from each other is taken into consideration, and these numbers of rotations per unit time of these screws 13 and 14 are defined as 13N and 14N, respectively. In this case, the following formula 84) may preferably be satisfied.

$$[14cV\times 14cM\times 14N]\geq[13eV\times 13eM\times 13N] \quad (4)$$

In addition to the above-described relationship between the helical blade 13*e* of the supplying screw 13 and the helical blade 14*c* of the stirring screw 14, with respect to the longitudinal direction of the supplying screw 13, the third opening 15*c* is disposed downstream of the discharge opening 20 in the arrow g direction, so that the airflow flowed from the region d2 flows through the third opening 15*e* of the region d3 into the stirring screw 14 side before the airflow reaches the discharge opening 20.

Incidentally, in this embodiment, arrangement of the third opening 15*c* on the side downstream of the discharge opening 20 with respect to the arrow g direction means that as shown in FIG. 5, with respect to the arrow g direction, a leading end portion (downstream end) 15*e*W of the third opening 15*c* may only be required to be positioned downstream of a leading end portion (downstream end) 20W of the discharge opening 20. That is, the entirety of the third opening 15*c* does not have to be positioned downstream of the leading end portion 20W of the discharge opening 20 with respect to the arrow g direction. However, the entirety of the third opening 15*c* may be positioned downstream of the leading end portion 20W of the discharge opening 20 with respect to the arrow g direction.

[Height of Each of Openings]

Next, a height direction of the wall surface of each of the first opening 15*a*, the second opening 15*b*, and the third opening 15*c* will be described. Parts (a), (b) and (c) of FIG. 8 are sectional views showing the first opening 15*a*, the second opening 15*b*, and the third opening 15*c*, respectively.

As shown in parts (a) to (c) of FIG. 8, compared with developer surface heights in the regions d1 and d2 of the first opening 15*a* and the second opening 15*b* through which the developer is delivered between the stirring screw 14 side (stirring chamber 12) and the supplying screw 13 side (developing chamber 11), a developer surface height of the developer moving toward the discharge opening is low. In this embodiment, heights of the partition walls 15 in the regions d1, d2 and d3 of the first opening 15*a*, the second opening 15*b*, and the third opening 15*c*, respectively, are changed. That is, with respect to a vertical direction, a lower end portion of an opening of the third opening 15*c* is positioned above lower end portions of openings of the first opening 15*a* and the second opening 15*b*.

The developer is basically delivered in the regions d1 and d2 through the first opening 15*a* and the second opening 15*b*, respectively, so that the developer is moved and circulated between the developing chamber 11 and the stirring chamber 12. For that reason, when the height of the downstream 15 in each of the first opening 15*a* and the second opening 15*b* is excessively high, a developer delivering property lowers. Incidentally, as described above, the first opening 15*a* permits communication of the developer from the developing chamber 11 to the stirring chamber 12, but in the region d1 of the first opening 15*a*, communication of the airflow is established between the developing chamber 11 and the stirring chamber 12 in some instances. Further, as described above, the second opening 15*b* permits communication of the developer from the stirring chamber 12 to the developing chamber 11, but in the region d2 of the second opening 15*b*, communication of the airflow is established between the developing chamber 11 and the stirring chamber 12 in some instances.

On the other hand, the third opening 15*c* aims at sending the airflow, flowing toward the discharge opening 20, to the stirring chamber 12 in the region d3. Further, the developer which gets over the obstacle that pushes back the developer to the downstream side and which moves to the upstream side is an excessive developer, and therefore, it is desirable that the developer is not delivered to the stirring chamber 12 and is basically fed to the discharge opening 20. Incidentally, as described above, the third opening 15*c* permits communication of the developer between the developing chamber 11 and the stirring chamber 12, but in the region d3 of the third opening 15*c*, but the developer fed by the airflow flowing toward the discharge opening 20 is moved from the developing chamber 11 to the stirring chamber 12 in some instances.

Accordingly, by making the height of the third opening 14*c* higher than the heights of the first opening 15*a* and the second opening 15*b*, roughly, in the region d3 of the third opening 15*c*, only the airflow flowing toward the discharge opening 20 is sent to the stirring chamber 12, and the developer to be originally discharged is fed to the discharge opening 20 without being delivered to the stirring chamber 12.

By the above-described constitution, the developer fed by the airflow is moved to the stirring screw 14 side without being discharged through the discharge opening 20. The airflow flowed into the stirring screw 14 side passes through the air-discharging opening 16 positioned above the stirring screw 14 with respect to the vertical (perpendicular) direction, and the developer mixed with the airflow is, as described above, separated from the airflow by gravitation when the airflow is raised toward the air-discharging opening 16 and falls into the stirring chamber 12. The above-described developer is fed to the region d2 again by the helical blade 14*c* of the supplying screw 14 and is mixed with the developer fed by the stirring screw 14 in the region d2.

[Discharge Characteristic of Discharge Opening]

Next, a discharge characteristic of the developer discharged through the discharge opening 20 in the developing device 1Y will be described using FIG. 9. In FIG. 9, an outline of a relationship of a discharge amount relative to a developer amount when the abscissa represents the developer amount in the developing device 1Y, and the ordinate represents the discharge amount (ACR discharge amount) of the developer discharged through the discharge opening 20 of the developing device 1Y.

As described above, when the developer amount in the developing device 1Y is increased by the supplying opening or the like as described above, a volume of the developer in the developing container 2 becomes large, so that the discharge amount of the developer through the discharge opening 20 in the developing device 1Y increases as indicated by a broken line of FIG. 9 while following the increase in volume of the developer. However, the developer amount in the developing device 1Y is not increased to a certain (predetermined) amount or more and is discharged through the discharge opening 20 correspondingly to an amount of the developer supplied to the developing device 1Y. On the other hand, on a side where the developer amount is small, the volume of the developer in the developing container 2 is also small, and therefore, the discharge amount of the developer through the discharge opening 20 is zero or changes in the neighborhood of zero.

[Effect of Third Opening]

An effect in the case where the third opening 15*c* is provided in the region d3 as in this embodiment will be described using parts (a) and (b) of FIG. 10. In each of a state of a comparison example (part (a) of FIG. 10) in which the third opening 15*c* is not provided and a state of this embodiment (part (b) of FIG. 10) in which the third opening 15*c* is provided, in the case where a driving speed of the developing device is changed, the discharge amount (ACR discharge amount) of the developer discharged through the discharge opening 20 was measured.

The constitution of the developing device 1Y used in each of the comparison example and this embodiment (first embodiment) is as follows. As the developing sleeve 3, a developing sleeve of φ18 mm in diameter was used. As the supplying screw 13, the following supplying screw was used.

The supplying screw includes a rotation shaft 13*a* and helical blades 13*b*, 13*c*, 13*d*, 13*e*, 13*f* and 13*g*, in which a diameter is 14 mm for the helical blades 13*b* to 13*g*, a diameter (shaft diameter) of the rotation shaft 13*a* is 9 mm, and a pitch per one-full circumference of the screw is 20 mm for the helical blade 13*b*, 10 mm for the helical blades 13*c* and 13*e*, and 5 mm for the helical blades 13*d*, 13*g* and 13*f*.

As the stirring screw 14, the following stirring screw was used. The stirring screw includes a rotation shaft 14*a* and helical blades 14*b* and 14*c*, in which a diameter is 14 mm for the helical blades 14*b* and 14*c*, a diameter (shaft diameter) of the rotation shaft 14*a* is 6 mm, and a pitch per one-full circumference of the screw is 20 mm for the helical blades 14*b* and 14*c*. A width (length in the rotational axis direction) of each of the openings 15*a*, 15*b* and 15*c* is set at 15-20 mm. Incidentally, in the comparison example, the third opening 15*c* is not provided. Each of the openings may desirably be formed in size equal to or larger than the pitch of the associated one of the supplying screw 13 and the stirring screw 14.

In parts (a) and (b) of FIG. 10, results of measurement of the discharge amount of the developer discharged through the discharge opening 20 in each developer amount at the rotational speed of 600 [mm/sec] (high speed) and of 200 [mm/sec] (low speed) of the developing sleeve 3 in a state of "WITH NO" third opening 15*c* (state in which the partition wall 15 exists as it is, comparison example) and in a state of "WITH" third opening 15*c* (this embodiment (first embodiment), respectively, are shown. Here, similarly as in FIG. 9, in FIG. 10, the abscissa represents the developer amount of the developing device 1Y, and the ordinate represents the discharge amount (ACR discharge amount) of the developer discharged through the discharge opening 20 of the developing device 1Y. Further, as regards the discharge amount, the discharge amount at the high speed is represented by a solid black triangle (part (a) of FIG. 10) or a solid black circle (part (b) of FIG. 10), and the discharge amount at the low speed is represented by a white (hollow) triangle (part (a) of FIG. 10) or a white (hollow) circle (part (b) of FIG. 10).

As shown in part (a) of FIG. 10, in the state of "WITH NO" third opening 15*c* in the region d3 in the comparison example, in the case where the rotational speed of the developing sleeve 3 is high, when the discharge amount is observed from the case where the developer amount of the developer in the developing container 2 is small toward the case where the developer amount of the developer in the developing container 2 is large (from a left-hand) side toward a right(-hand) side of part (a) of FIG. 10), in a state in which the developer amount is increased to some extent, the ACR discharge amount is increased although the developer amount is such that the developer should not be originally discharged in the developer amount, so that the developer is excessively discharged. This is because as described above, the amount of the developer which is raised by the helical blades of the supplying screw 13 and the stirring screw 14 and which flows in mixture with the airflow drawn from the outside of the developing device 1Y by rotation of the developing sleeve 3, the supplying screw 13, and the stirring screw 14.

Further, when the developer amount in the developing container 2 is further increased, even in either case of the high rotational speed and the low rotational speed of the developing sleeve 3, the ACR discharge amount abruptly increases. This discharge is an expected normal discharge and the above increase is caused because the developer amount of the developer flowing into the region d2 increases with the increase in developer amount and the developer amount of the developer fed by the helical blade 13*d* in the direction of the discharge opening 20 increases.

Further, when the developing device with the constitution of the comparison example is mounted in the image forming apparatus and the image is outputted in the state in which the rotational speed of the developing sleeve 3 is high, the developer amount in the developing container 2 is further lowered due to the above-described excessive discharge with the airflow. Then, the developer is not fed to the developing sleeve 3, so that a white stripe image (abnormal image) such that the toner is not partially placed on the recording material occurred in the output image of the image forming apparatus.

On the other hand, in the case of "WITH" third opening 15*c* in the region d3 in this embodiment, as described above, the excessive discharge of the developer with the airflow is suppressed, and therefore, even in either case of the high rotational speed and the low rotational speed of the developing sleeve 3, the developer amount of the developer in the developing container 2 was maintained constant. Then, even when image formation was carried out after the developing device with the constitution of this embodiment (first embodiment) was actually mounted in the image forming apparatus and then the output image was checked, the white stripe image did not occur.

Thus, in this embodiment, it is possible to suppress that the developer is discharged through the discharge opening 20 by the airflow drawn by the rotation of the developing sleeve 3, so that the occurrence of the abnormal image can be suppressed. That is, from the above-described result, as regards the developing device 1Y, even in the case where the process speed is high, it becomes possible to suppress the discharge of the developer through the discharge opening 20 by the airflow, so that it became possible to realize an image forming apparatus capable of outputting a stable image even with a time.

Second Embodiment

A second embodiment will be described using FIGS. 11 and 12. In the above-described first embodiment, the constitution in which the supply opening 19 is provided in the upstream position of the stirring screw 14 with respect to the developer feeding direction and the discharge opening 20 is provided in the upstream position of the supplying screw 13 with respect to the developer feeding direction was described. On the other hand, in this embodiment, a constitution in which the supply opening 19 is provided in the upstream position of the stirring screw 14A with respect to the developer feeding direction and the discharge opening 20 is provided at a lower surface of the developing container 2 in a downstream position of the supplying screw 13A with respect to the developer feeding direction. That is, in this embodiment, the position of the discharge opening 20 is made different from the position in the first embodiment. Further, with a container in position of the discharge opening 20, shapes and directions of helical blades of a supplying screw 13A and a stirring screw 14A and a longitudinal position of the third opening 15*c* were changed. Other constitutions and functions are similar to those in the first embodiment, and therefore, similar constituent elements are represented by the same reference numerals or symbols, and description and illustration thereof will be omitted or briefly made. In the following, a difference from the first embodiment will be principally described.

As shown in FIG. 11, also, in the case of this embodiment, similarly as in the first embodiment, the developer is fed in the arrow g direction (first direction) and the arrow h direction (second direction) by the rotation of the supplying screw 13A and the stirring screw 14A, respectively, so that the developer in the developing device 1Y is moved and circulated between the developing chamber 11 and the stirring chamber 12 while being stirred. Also, as regards the supply opening 19, similarly as in the first embodiment, the supply opening 19 is provided in the stirring chamber 12, in which the stirring screw 14A is disposed, on a side further upstream of the first opening 15*a* with respect to the arrow h direction.

On the other hand, the discharge opening 20 through which the developer in the developing device 1Y is discharged little by little is provided at a position indicated by a broken line in FIG. 11 in the bottom plate portion 2*a* (see FIG. 2) of the developing container 2 so as to open downward. That is, with respect to the feeding direction (arrow g direction) of the developer in the developing chamber 11 in which a supplying screw 13A is disposed, the discharge opening 20 is provided in a position on a further downstream side than the first opening 15*a* through which the developer flows into the stirring chamber 12. Most of the developer fed in the developing chamber 11 is delivered to the stirring chamber 12 through the first opening 15*a*. On the other hand, a part of the developer moves toward the discharge opening 20 side, and is discharged to the outside of the developing device 1Y through the discharge opening 20. The developer discharged to the outside of the developing device 1Y through the discharge opening 20 passes through an unshown collecting toner discharging passage and is accommodated in an unshown collecting toner tank.

The stirring screw 14A as a second feeding screw for feeding the developer in the stirring chamber 12 in the arrow h direction is provided with the helical blade 14*b* rotated around the rotation shaft 14*a* similarly as in the first embodiment. That is, the stirring screw 14A includes a third feeding portion for feeding the developer in the arrow h direction from the first opening 15*a* toward the second opening 15*b*, and the helical blade 14*b* is disposed in the third feeding portion. This stirring screw 14A extends to the supply opening 19, and then is fed together with the toner (developer) supplied through the supply opening 19, in the arrow h direction.

Further, on a downstream side of the arrow h direction of the stirring screw 14A, another helical blade 14*c* rotatable in a direction opposite to the direction of the helical blade 14*b* is provided. In this embodiment, the position of the discharge opening is different from the position in the first embodiment, and therefore, a length and a position of another helical blade 14*c* rotated in the direction opposite to the direction of the helical blade 14*b* of the stirring screw 14 are different from those in the first embodiment. At a boundary between the helical blade 14*b* and the helical blade 14*c*, the second opening 15*b* is provided, so that the developer is delivered to the developing chamber 11.

The supplying screw 13A as the first feeding screw for feeding the developer in the arrow g direction is provided with the helical blade 14*b* around the rotation shaft 13*a* similarly as in the first embodiment. Further, the supplying screw 13A is provided with the helical blade 13*d* rotated in the direction opposite to the direction of the helical blade 13*b* in a downstream position thereof with respect to the developer feeding direction, and the helical blade 13*d* pushes back the developer fed in the arrow g direction. That is, the supplying screw 13 includes a first feeding portion where the supplying screw 13 feeds the developer in the arrow g direction from the second opening 15*b* toward the first opening 15*a* and a second feeding portion which is disposed on a side downstream of the first feeding portion with respect to the arrow g direction and where the supplying screw 13 feeds a part of the developer in a direction opposite to the arrow g direction. In the first feeding portion and the second feeding portion, the helical blade 13*b* as a first feeding blade and the helical blade 13*d* as a second feeding blade are disposed, respectively. The discharge opening 20 is disposed in the developing chamber 11 on a side downstream of the first opening 15*a* with respect to the arrow g direction and through which the developer getting over the second feeding portion is discharged.

By providing the first opening 15*a* at the boundary between the helical blade 13*b* and the helical blade 13*d*, most of the developer is delivered to the developing chamber 11. Further, a part of the developer in the region of the helical blade 13*c* and the helical blade 13*d* moves further toward the downstream side against an obstacle by the helical blade 13*d* functioning such that the helical blade 13*d* pushes back toward the upstream side, and then the developer which gets over the obstacle and which moves to the downstream side is fed to the discharge opening 20 by the helical blade 13*e*. That is, the helical blade 13*e* as the third feeding blade is disposed on the side downstream of the helical blade 13*d* with respect to the arrow g direction and feeds the developer, getting over the helical blade 13*d*, in the arrow g direction toward the discharge opening 20.

Further, on a most downstream side of the supplying screw 13A with respect to the arrow g direction, similarly as in the first embodiment, a helical blade 13*g* which performs a function of feeding the developer, which is not satisfactorily discharged through the discharge opening 20 although passes through the discharge opening 20 by being fed by the helical blade 13*e*, toward the upstream side with respect to the arrow g direction (first direction) so as to be pushed back toward the discharge opening 20 side.

Further, in this embodiment, the third opening 15*c* is provided on a side downstream of the helical blade 13*d* of the supplying screw 13A and upstream of the discharge opening 20 with respect to the arrow g direction, and d3 represents a region in which the third opening 15*c* is provided. That is, the third opening 15*c* is provided downstream of the first opening 15*a* of the partition wall 15 with respect to the arrow g direction and permits communication of the airflow between the developing chamber 11 and the stirring chamber 12. Further, with respect to the arrow g direction, an upstream end of the third opening 15*c* is positioned upstream of an upstream end of the discharge opening 20. Further, an opening area of the third opening 15*c* is larger than an opening area of the discharge opening 20.

The third opening 15*c* is disposed on the upstream side of the supplying screw 13A relative to the discharge opening 20 with respect to the arrow g direction, so that the airflow which does not flow from the developing chamber 11 to the chamber 12 in the region d1 is sent from the developing chamber 11 to the stirring chamber 12 in the region d3. At this time, the helical blade 14*b* of the stirring screw 14A is rotated in the direction in which the developer is fed from the region d3 toward the region d1 and functions so as to draw the airflow from the developing chamber 11 toward the stirring chamber 12 side in the region d3 by rotation of the helical blade 14*b*.

That is, the stirring screw 14A includes the helical blade 14*b* as the second chamber-side blade provided helically around the rotation shaft 14*a* so as to feed the developer in the region where the third opening 15*c* exists with respect to the arrow h direction. Further, the helical blade 14*b* disposed in the third feeding portion is extended to the region where the third opening 15*c* exists with respect to the arrow h direction. On the other hand, the supplying screw 13A includes the helical blade 13*e* as the first chamber-side blade provided helically around the rotation shaft 13*a* so as to feed the developer toward the discharge opening 20 in the region where the third opening 15*c* exists with respect to the arrow g direction.

Further, in the case where the helical blade 14*c* in the above-described formula (2) is replaced with the helical blade 14*b*, the above-described formula (3) is satisfied. That is, the volume 13*e*V in which the developer passes when the helical blade 13*e* rotates one full turn and the volume 14*b*V in which the developer passes when the helical blade 14*b* rotates one full turn satisfy: 14*b*V≥13*e*V.

Particularly, in this embodiment, it is preferable that a region through which the helical blade 14*b* passes per unit time by rotation of the rotation shaft 14*a* is made larger than a region through which the helical blade 13*e* passes per unit time by rotation of the rotation shaft 13*a*.

As shown in FIG. 12, in this embodiment, a part of the airflow generated by the rotation of the developing sleeve 3 and the supplying screw 13A in the developing device 1Y flows into the stirring chamber 12 through the first opening 15*a*, and another part of the airflow flows in the direction of the discharge opening 20. The airflow flowed in the direction of the discharge opening 20 is drawn through the third opening 15*c* by the rotation of the stirring screw 14A, so that the airflow flowing through the discharge opening 20 is reduced.

As a result, the amount of the developer, discharged through the discharge opening 20, a part of which peeled off from the above-described non-magnetic region (FIG. 2) of the developing sleeve 3 and the developer raised by the rotational operation of the supplying screw 13A and the stirring screw 14A are mixed with the airflow is reduced.

Incidentally, also in the constitution of this embodiment, as regards an effect of the third opening 15*c* in the region d3, similar effects to those described with reference to parts (a) and (b) of FIG. 10 were obtained as a result that the discharge amount of the developer discharged through the discharge opening 20 was measured in each of a state of this embodiment (second embodiment) in which the third opening 15*c* was provided and the state of the comparison example in which the third opening 15*c* was not provided.

Further, the constitution of the developing device 1Y used in each of this embodiment (second embodiment) and the comparison example is as follows. As the developing sleeve 3, a developing sleeve of φ18 mm in diameter was used. As the supplying screw 13A, the following supplying screw was used.

The supplying screw includes a rotation shaft 13*a* and helical blades 13*b*, 13*d*, 13*e*, and 13*g*, in which a diameter is 14 mm for the helical blades 13*b*, 13*d*, 13*e* and 13*g*, a diameter (shaft diameter) of the rotation shaft 13*a* is 9 mm, and a pitch per one-full circumference of the screw is 20 mm for the helical blade 13*b*, 10 mm for the helical blade 13*e*, and 5 mm for the helical blades 13*d* and 13*g*.

As the stirring screw 14A, the following stirring screw was used. The stirring screw includes a rotation shaft 14*a* and helical blades 14*b* and 14*c*, in which a diameter is 14 mm for the helical blades 14*b* and 14*c*, a diameter (shaft diameter) of the rotation shaft 14*a* is 6 mm, and a pitch per one-full circumference of the screw is 20 mm for the helical blade 14*b* and is 5 mm for the helical blade 14*c*. A width (length in the rotational axis direction) of each of the openings 15*a*, 15*b* and 15*c* is set at 15-20 mm. Incidentally, in the comparison example, the third opening 15*c* is not provided. Each of the openings may desirably be formed in size equal to or larger than the pitch of the associated one of the supplying screw 13A and the stirring screw 14A.

Also, in the case of this embodiment, the occurrence of the abnormal image can be suppressed. That is, by the above-described result, it became possible that the developing device 1Y of this embodiment discharged the developer little by little by an amount depending on the amount of the developer accommodated in the developing device 1Y even when the process speed changed in the constitution in which the discharge opening 20 was provided on the downstream side of the developing chamber 11 with respect to the developer feeding direction. That is, even in the case where the process speed is high, it becomes possible to suppress the discharge of the developer through the discharge opening 20 by the airflow, so that it became possible to realize an image forming apparatus capable of outputting a stable image even with a time.

Third Embodiment

A third embodiment will be described using FIGS. 13 and 14. In the above-described first and second embodiments, the constitution in which the discharge opening 20 is provided in the upstream position or the downstream position of the supplying screw 13 with respect to the developer feeding direction was described. On the other hand, in this embodiment, a constitution in which the supply opening 19 is provided in the upstream position of the stirring screw 14B with respect to the developer feeding direction and the discharge opening 20 is provided at a lower surface of the developing container 2 in a downstream position of the stirring screw 14B with respect to the developer feeding direction. That is, in this embodiment, the position of the discharge opening 20 is in the stirring chamber 12. Further, with a container in position of the discharge opening 20, shapes and directions of helical blades of a supplying screw 13B and a stirring screw 14B and a longitudinal position of the third opening 15*c* were changed. Other constitutions and functions are similar to those in the first embodiment, and therefore, similar constituent elements are represented by the same reference numerals or symbols, and description and illustration thereof will be omitted or briefly made. In the following, a difference from the first embodiment will be principally described.

As shown in FIG. 13, also, in the case of this embodiment, similarly as in the first embodiment, the developer is fed in the arrow g direction (first direction) and the arrow h direction (second direction) by the rotation of the supplying screw 13B and the stirring screw 14B, respectively, so that the developer in the developing device 1Y is moved and circulated between the developing chamber 11 and the stirring chamber 12 while being stirred. Also, as regards the supply opening 19, similarly as in the first embodiment, the supply opening 19 is provided in the stirring chamber 12, in which the stirring screw 14B is disposed, on a side further upstream of the first opening 15*a* with respect to the arrow h direction.

The stirring screw 14B as the second feeding screw for feeding the developer in the stirring chamber 12 in the arrow h direction is provided with the helical blade 14*b* around the rotation shaft 14*a* similarly as in the first embodiment. That is, the stirring screw 14B includes the second feeding portion for feeding the developer in the arrow h direction from the first opening 15*a* toward the second opening 15*b*, and the helical blade 14*b* is disposed in the second feeding portion. This stirring screw 14B extends to the supply opening 19, and the developer is fed together with the toner (developer) supplied through the supply opening 19, in the arrow h direction.

The discharge opening 20 through which the developer in the developing device 1Y is discharged little by little is provided at a position indicated by a broken line in FIG. 13 in the bottom plate portion 2*a* (see FIG. 2) of the developing container 2 so as to open downward. That is, with respect to the feeding direction (arrow h direction) of the developer in the stirring chamber 12 in which the stirring screw 14B is disposed, the discharge opening 20 is provided in a position on a further downstream side than the second opening 15*b* through which the developer flows into the developing chamber 11. Most of the developer fed in the stirring chamber 12 is delivered to the developing chamber 11 through the second opening 15*b*. On the other hand, a part of the developer moves toward the discharge opening 20 side, and is discharged to the outside of the developing device 1Y through the discharge opening 20. The developer discharged to the outside of the developing device 1Y through the discharge opening 20 passes through an unshown collecting toner discharging passage and is accommodated in an unshown collecting toner tank.

Further, on a downstream side of the arrow h direction of the stirring screw 14B, another helical blade 14*c* rotatable in a direction opposite to the direction of the helical blade 14*b* is provided, and pushes back the developer fed in the arrow h direction. At a boundary between the helical blade 14*b* and the helical blade 14*c*, the second opening 15*b* is provided, so that most of the developer is delivered to the developing chamber 11. Further, a part of the developer in the region of the helical blade 14*b* and the helical blade 14*c* moves further toward the downstream side against an obstacle by the helical blade 14*c* functioning such that the helical blade 14*c* pushes back toward the upstream side, and then the developer which gets over the obstacle and which moves to the downstream side is fed to the discharge opening 20 by the helical blade 14*d*.

That is, the stirring screw 14B includes the above-described second feeding portion and a third feeding portion which is disposed downstream of the second feeding portion with respect to the arrow h direction and where the developer fed to the downstream side than the second opening 15*b* with respect to the arrow h direction is fed in the direction opposite to the arrow h direction. Further, the helical blade 14*b* as the first screw blade and the helical blade 14*c* as the second screw blade are disposed in the second feeding portion and the third feeding portion, respectively, and the helical blade 14*d* as the third screw blade is disposed downstream of the helical blade 14*c* with respect to the arrow h direction. Specifically, the helical blade 14*b* is provided helically around the rotation shaft 14*a* so as to feed the developer in the arrow h direction. The helical blade 14*c* is provided helically around the rotation shaft 14*a* so as to feed the developer in the direction opposite to the arrow h direction. The helical blade 14*d* is provided helically around the rotation shaft 14*a* so as to feed the developer, getting over the helical blade 14*c*, toward the discharge opening 20 in the arrow h direction.

Further, on a most downstream side of the stirring screw 14A with respect to the arrow h direction, a helical blade 14*e* which performs a function of feeding the developer, which is not satisfactorily discharged through the discharge opening 20 although passes through the discharge opening 20 by being fed by the helical blade 14*d*, toward the upstream side with respect to the arrow h direction (first direction) so as to be pushed back toward the discharge opening 20 side. That is, the helical blade 14*e* is provided helically around the rotation shaft 14*a* so as to feed the developer in the direction opposite to the arrow h direction.

The supplying screw 13B as the first feeding screw performs, similarly as in the first embodiment, the function such that the supplying screw 13*b* feeds the developer passing through the second opening 15*b* provided in the region d2 and flowing into the developing chamber 11, to the first opening 15*a* provided in the region d1 in the arrow g direction by the helical blade 13*b* and then delivers the fed developer towards the stirring chamber 12 through the first opening 15*a*. That is, the supplying screw 13B includes the first feeding portion where the developer is fed in the arrow g direction toward the first opening 15*a* through the second opening 15*b*. Further, the helical blade 13*b* is disposed in the first feeding portion.

Further, on the side downstream of the helical blade 13*b* with respect to the arrow g direction, the helical blade 13*f* rotated in the direction opposite to the direction of the helical blade 13*b* is provided. A boundary between those helical blades 13*b* and 13*f* is positioned in the region d1 in which the first opening 15*a* is provided. For this reason, the developer fed in the arrow g direction is prevented from further advancing by the helical blade 13*f*, and flows into the stirring chamber 12 through the first opening 15*a*.

In this embodiment, the third opening 15*c* is provided on a side downstream of the helical blade 14*c* of the stirring screw 14A and upstream of the discharge opening 20 with respect to the arrow h direction, and d3 represents a region in which the third opening 15*c* is provided. That is, the third opening 15*c* is provided downstream of the second opening 15*b* of the partition wall 15 with respect to the arrow h direction and permits communication of the airflow between the developing chamber 11 and the stirring chamber 12. Further, with respect to the arrow g direction, an upstream end of the third opening 15*c* is positioned upstream of an upstream end of the discharge opening 20. Further, an opening area of the third opening 15*c* is larger than an opening area of the discharge opening 20.

The third opening 15*c* is disposed on the upstream side of the stirring screw 14A relative to the discharge opening 20 with respect to the arrow h direction, so that the airflow which does not flow from the stirring chamber 12 to the developing chamber 11 in the region d2 is sent from the stirring chamber 12 to the developing chamber 11 in the region d3. At this time, the helical blade 13*b* of the supplying screw 13B on the developing chamber 11 side is rotated in the direction in which the developer is fed from the region d3 toward the region d2 and functions so as to draw the airflow from the stirring chamber 12 toward the developing chamber 11 side in the region d3 by rotation of the helical blade 13*b*.

That is, the supplying screw 13B includes the helical blade 13*b* as the first chamber-side blade provided helically around the rotation shaft 13*a* so as to feed the developer in the region where the third opening 15*c* exists with respect to the arrow g direction. Further, the helical blade 13*b* disposed in the first feeding portion is extended to the region where the third opening 15*c* exists with respect to the arrow g direction. On the other hand, the stirring screw 14A includes the helical blade 14*e* as the second chamber-side blade provided helically around the rotation shaft 14*a* so as to feed the developer toward the discharge opening 20 in the region where the third opening 15*c* exists with respect to the arrow h direction.

Further, the helical blade 13*e* in the above-described formula (1) is replaced with the helical blade 13*e*, the helical blade 14*c* in the above-described formula (2) is replaced with the helical blade 14*e*, and a direction of an inequality of the above-described formula (3) is reversed is satisfied. That is, the volume 13*b*V in which the developer passes when the helical blade 13*b* rotates one full turn and the volume 14*e*V in which the developer passes when the helical blade 14*e* rotates one full turn satisfy: 14*e*V≤13*b*V.

Particularly, in this embodiment, it is preferable that a region through which the helical blade 13*b* passes per unit time by rotation of the rotation shaft 13*a* is made larger than a region through which the helical blade 14*e* passes per unit time by rotation of the rotation shaft 14*a*.

As shown in FIG. 13, in this embodiment, a part of the airflow generated by the rotation of the developing sleeve 3 and the supplying screw 13B in the developing device 1Y flows into the stirring chamber 12 through the second opening 15*b*, and another part of the airflow flows in the direction of the discharge opening 20. Further, a part of the airflow generated by the rotation of the stirring screw 14 flows in the direction of the discharge opening 20. The airflow flowed in the direction of the discharge opening 20 is drawn through the third opening 15*c* by the rotation of the supplying screw 13B, so that the airflow flowing through the discharge opening 20 is reduced.

As a result, the amount of the developer, discharged through the discharge opening 20, a part of which peeled off from the above-described non-magnetic region (FIG. 2) of the developing sleeve 3 and the developer raised by the rotational operation of the supplying screw 13B and the stirring screw 14B are mixed with the airflow is reduced.

Incidentally, also in the constitution of this embodiment, as regards an effect of the third opening 15*c* in the region d3, similar effects to those described with reference to parts (a) and (b) of FIG. 10 were obtained as a result that the discharge amount of the developer discharged through the discharge opening 20 was measured in each of a state of this embodiment (second embodiment) in which the third opening 15*c* was provided and the state of the comparison example in which the third opening 15*c* was not provided.

Further, the constitution of the developing device 1Y used in each of this embodiment (second embodiment) and the comparison example is as follows. As the developing sleeve 3, a developing sleeve of φ18 mm in diameter was used. As the supplying screw 13B, the following supplying screw was used.

The supplying screw includes a rotation shaft 13*a* and helical blades 13*b* and 13*f*, in which a diameter is 14 mm for the helical blades 13*b* and 13*f*, a diameter (shaft diameter) of the rotation shaft 13*a* is 9 mm, and a pitch per one-full circumference of the screw is 20 mm for the helical blade 13*b*, and 5 mm for the helical blades 13*f*.

As the stirring screw 14B, the following stirring screw was used. The stirring screw includes a rotation shaft 14*a* and helical blades 14*b*, 14*c*, 14*d* and 14*e*, in which a diameter is 14 mm for the helical blades 14*b*, 14*c*, 14*d* and 14*e*, a diameter (shaft diameter) of the rotation shaft 14*a* is 6 mm, and a pitch per one-full circumference of the screw is 20 mm for the helical blade 14*b*, 10 mm for the helical blades 14*c* and 14*d*, and 5 mm for the helical blade 14*e*. A width (length in the rotational axis direction) of each of the openings 15*a*, 15*b* and 15*c* is set at 15-20 mm. Incidentally, in the comparison example, the third opening 15*c* is not provided. Each of the openings may desirably be formed in size equal to or larger than the pitch of the associated one of the supplying screw 13B and the stirring screw 14B.

Also, in the case of this embodiment, the occurrence of the abnormal image can be suppressed. That is, by the above-described result, it became possible that the developing device 1Y of this embodiment discharged the developer little by little by an amount depending on the amount of the developer accommodated in the developing device 1Y even when the process speed changed in the constitution in which the discharge opening 20 was provided on the downstream side of the stirring chamber 12 with respect to the developer feeding direction. That is, even in the case where the process speed is high, it becomes possible to suppress the discharge of the developer through the discharge opening 20 by the airflow, so that it became possible to realize an image forming apparatus capable of outputting a stable image even with a time.

Fourth Embodiment

A fourth embodiment will be described using FIGS. 15, 16 and 17. In the above-described first embodiment, the constitution in which the discharge opening 20 is provided in the bottom plate portion 2*a* of the developing container 2 (see FIG. 2) in the upstream position of the supplying screw 13 with respect to the developer feeding direction so as to open downward was described. On the other hand, in this embodiment, the discharge opening 20A is provided in a side wall 2*c* of the developing container 2 so as to open sideward. Other constitutions and functions are similar to those in the first embodiment, and therefore, similar constituent elements are represented by the same reference numerals or symbols, and description and illustration thereof will be omitted or briefly made. In the following, a difference from the first embodiment will be principally described.

In the case of this embodiment, the discharge opening 20A is provided, as shown in FIGS. 15 and 16, in the side which opposes the partition wall 15 and which forms the developing chamber 11 between itself and the partition wall 15. In other words, the discharge opening 20A is provided in a wall surface of the developing chamber 11 on a side opposite from the downstream 15. Incidentally, the supplying screw 13 and the stirring screw 14 in this embodiment are similar to those in the constitution of the first embodiment. Further, a positional relationship of the respective helical blades of the supplying screw 13 and the stirring screw 14 with the first opening 15*a*, the second opening 15*b*, and the third opening 15*c* with respect to the developer feeding direction is also similar to the positional relationship in the first embodiment. Further, an opening area of the third opening 15*a* is larger than an opening area of the discharge opening 20A.

As shown in FIG. 15, in a most upstream helical blade 13*g* and a helical blade 13*e* positioned downstream thereof of the supplying screw 13 with respect to the arrow g direction (first direction), the developer which gets over an obstacle by a helical blade 13*d* positioned downstream of the helical blade 13*e* with respect to the arrow g direction and which moves toward an upstream side in the arrow g direction is discharged through the discharge opening 20A.

As described in the first embodiment, in the second opening 15*b* formed in the partition wall 15, the developer is delivered from the stirring screw 14 side to the supplying screw 13 side, and therefore, a developer surface height of the region d2 naturally becomes high. Further, the airflow does not readily flow from the supplying screw 13 side to the stirring screw 14 side, so that most of the airflow flows, with respect to the feeding direction, toward a further upstream side of the supplying screw 13 as it is. For this reason, also, in the case of this embodiment, similarly as in the first embodiment, the partition wall 15 is provided with the third opening 15*c* as the third communication opening, and d3 represents the region where the third opening 15*c* is provided. By employing such a constitution, similarly as in the first embodiment, the airflow flowing toward the discharge opening 20A can be sent to the stirring chamber 12 through the third opening 15*c* in the region d3, so that the amount of the developer discharged through the discharge opening 20A by the airflow can be suppressed.

Here, in the case where the discharge opening is provided in the bottom plate portion 2*a* of the developing container 2 as in the above-described first embodiment, when the amount of the developer abruptly increases in the developing device 1Y for various reasons and most of the developer gets over the helical blade 13*b* of the supplying screw 13, there is a liability that the developer is discharged through the discharge opening as it is.

Therefore, in this embodiment, the discharge opening 20A is provided in the side wall 2*c*, so that the developer is temporarily stored. That is, by providing the discharge opening 20A in the wall surface, between the helical blades 13*e* and 13*g*, the developer fed by the helical blade 13*e* is pushed back by the helical blade 13*g* and is temporarily stagnated in this region. By this, when the developer amount abruptly changes, excessive discharge of the developer can be suppressed.

Particularly, immediately after the exchange of the developer in the developing device 1Y, the above-described phenomenon is liable to occur, so that by employing the constitutions in this embodiment, it is possible to suppress that a fresh developer exchanged is discharged immediately.

Further, as regards a relationship with respect to the vertical direction (height direction) between the discharge opening 20A and the third opening 15*c*, as shown in FIG. 17, a lower end portion of the opening of the discharge opening 20A is positioned below a lower end portion of the third opening 15*c*. Particularly, in this embodiment, an upper end portion of the discharge opening 20A is positioned below the lower end portion of the third opening 15*c*. Thus, by making the height of the discharge opening 20A lower than a lower limit of the opening of the third opening 15*c*, the developer in the neighborhood of the discharge opening 20A is prevented from moving to the outside through the third opening 15*c*.

Incidentally, also in the constitution of this embodiment, as regards an effect of the third opening 15*c* in the region d3, similar effects to those described with reference to parts (a) and (b) of FIG. 10 were obtained as a result that the discharge amount of the developer discharged through the discharge opening 20 was measured in each of a state of this embodiment (second embodiment) in which the third opening 15*c* was provided and the state of the comparison example in which the third opening 15*c* was not provided.

The constitution of the developing device 1Y used in each of the comparison example and this embodiment (fourth embodiment) is as follows. As the developing sleeve 3, a developing sleeve of φ18 mm in diameter was used. As the supplying screw 13, the following supplying screw was used.

The supplying screw includes a rotation shaft 13*a* and helical blades 13*b*, 13*c*, 13*d*, 13*e*, 13*f* and 13*g*, in which a diameter is 14 mm for the helical blades 13*b*, 13*c*, 13*d*, 13*e*, 13*f* and 13*g*, a diameter (shaft diameter) of the rotation shaft 13*a* is 9 mm, and a pitch per one-full circumference of the screw is 20 mm for the helical blade 13*b*, 10 mm for the helical blade 13*c* and 13*e*, and 5 mm for the helical blades 13*d*, 13*g* and 13*f*.

As the stirring screw 14A, the following stirring screw was used. The stirring screw includes a rotation shaft 14*a* and helical blades 14*b* and 14*c*, in which a diameter is 14 mm for the helical blades 14*b* and 14*c*, a diameter (shaft diameter) of the rotation shaft 14*a* is 6 mm, and a pitch per one-full circumference of the screw is 20 mm for both the helical blades 14*b* and 14*c*. A width (length in the rotational axis direction) of each of the openings 15*a*, 15*b* and 15*c* is set at 15-20 mm. Incidentally, in the comparison example, the third opening 15*c* is not provided. Each of the openings may desirably be formed in size equal to or larger than the pitch of the associated one of the supplying screw 13 and the stirring screw 14.

Other Embodiments

In the above-described first to third embodiments, the constitutions in which the discharge opening is provided in the bottom plate portion were described. In the above-described fourth embodiment, the constitution in which the discharge opening is provided in the side wall of the developing container was described. However, the constitution in which the discharge opening is provided in the side wall of the developing container may be applied to the second and third embodiments. That is, in the second and third embodiments, the position of the discharge opening may be changed from the bottom plate portion of the developing container to the side wall similarly as in the fourth embodiment.

In the above-described embodiments, the constitutions in which the image forming apparatus is the printer were described, but the present invention is also applicable to a copying machine, a facsimile machine, a multi-function machine, and the like. Further, the above-described embodiments were described as to an example in which the present invention is applied to the developing device provided in the image forming apparatus of a so-called tandem type. However, the present invention is not limited to the developing device provided in such an image forming apparatus, but may be a developing device provided in, for example, a monochromatic printer or the like, and is applicable to developing devices provided in image forming apparatuses of various types.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-192002 filed on Nov. 26, 2021, which is hereby incorporated by reference herein in its entirety.

What is claimed is:

1. A developing device comprising:

a rotatable developing member configured to carry and feed a developer containing toner and a carrier to a position where an electrostatic latent image formed on an image bearing member is developed;

a developing container including a first chamber in which the rotatable developing member is provided and in which the developer is supplied to the rotatable developing member and a second chamber which is partitioned from the first chamber by a partition wall and in which the developer is circulated between itself and the first chamber;

a first communication opening configured to permit communication of the developer from the first chamber to the second chamber;

a second communication opening configured to permit communication of the developer from the second chamber to the first chamber;

a first feeding screw provided in the first chamber and including:

a first rotation shaft;

a first blade portion provided downstream of an upstream end of the second communication opening with respect to a first direction from the second communication opening toward the first communication opening and formed in a helical shape on an outer peripheral surface of the first rotation shaft so as to feed the developer in the first direction; and a second blade portion provided upstream of a downstream end of the second communication opening and the first blade portion with respect to the first direction and formed in a helical shape on the outer peripheral surface of the first rotation shaft so as to feed the developer in a second direction opposite to the first direction;

a second feeding screw provided in the second chamber and including:

a second rotation shaft;

a third blade portion provided upstream of a downstream end of the second communication opening with respect to the second direction and formed in a helical shape on an outer peripheral surface of the second rotation shaft so as to feed the developer in the second direction; and a fourth blade portion provided downstream of an upstream end of the second communication opening and the third blade portion with respect to the second direction and formed in a helical shape on the outer peripheral surface of the second rotation shaft so as to feed the developer in the first direction;

a developer discharge opening provided in the first chamber and disposed upstream of the upstream end of the second communication opening with respect to the first direction so as to discharge the developer from the developing container; and a third communication opening provided upstream of the upstream end of the second communication opening with respect to the first direction so as to permit communication of airflow between the first chamber and the second chamber, wherein with respect to the second direction, the third communication opening overlaps with the second blade portion, wherein with respect to the first direction, the third communication opening overlaps with the fourth blade portion, and wherein with respect to the first direction, a downstream end of the third communication opening is positioned downstream of a downstream end of the developer discharge opening.

2. A developing device according to claim 1, wherein with respect to the first direction, the third communication opening overlaps with the developer discharge opening.

3. A developing device according to claim 1, wherein with respect to the first direction, an upstream end of the third communication opening is positioned downstream of the downstream end of the developer discharge opening.

4. A developing device according to claim 1, wherein in a case that a pitch per rotation of the second blade portion is P, a diameter of the second blade portion is Lb, a diameter of the first rotation shaft is Ls, a diameter per rotation of the fourth blade portion is P', a diameter of the fourth blade portion is Lb', and a diameter of the second rotation shaft is Ls', the following relationship is satisfied:

$$\pi\times((Lb/2)^2-(Ls/2)^2)\times P\leq\pi\times((Lb'/2)^2-(Ls'/2)^2)\times P'.$$

5. A developing device according to claim 4, wherein the following relationship is satisfied:

$$\pi\times((Lb/2)^2-(Ls/2)^2)\times P<\pi\times((Lb'/2)^2-(Ls'/2)^2)\times P'.$$

6. A developing device according to claim 1, wherein in a case that a pitch per rotation of the second blade portion is P, a diameter of the second blade portion is Lb, a diameter of the first rotation shaft is Ls, a number of threads of the second blade portion is M, a number of rotations per unit time of the first feeding screw is N, a pitch per rotation of the fourth blade portion is P', a diameter of the fourth blade portion is Lb', a diameter of the second rotation shaft is Ls', a number of threads of the fourth blade portion is M', and a number of rotations per unit time of the second feeding screw is N', the following relationship is satisfied:

$$\pi\times((Lb/2)^2-(Ls/2)^2)\times P\times M\times N<\pi\times((Lb'/2)^2-(Ls'/2)^2)\times P'\times M'\times N'.$$

7. A developing device according to claim 1, wherein the first feeding screw further includes:

a fifth blade portion provided upstream of the first blade portion and downstream of the second blade portion with respect to the first direction and formed in a helical shape on the outer peripheral surface of the first rotation shaft so as to feed the developer in the second direction; and a sixth blade portion provided upstream of the fifth blade portion and downstream of the second blade portion with respect to the first direction and formed in a helical shape on the outer peripheral surface of the first rotation shaft so as to feed the developer in the first direction, wherein with respect to the first direction, the second communication opening overlaps with the fifth blade portion.

8. A developing device according to claim 7, wherein the first feeding screw further includes a seventh blade portion provided upstream of the second blade portion with respect to the first direction and formed in a helical shape on the outer peripheral surface of the first rotation shaft so as to feed the developer in the first direction, wherein with respect to the first direction, the developer discharge opening overlaps with the seventh blade portion.

9. A developing device according to claim 1, wherein the first feeding screw further includes a fifth blade portion provided upstream of the second blade portion with respect to the first direction and formed in a helical shape on the outer peripheral surface of the first rotation shaft so as to feed the developer in the first direction, wherein with respect to the first direction, the developer discharge opening overlaps with the fifth blade portion.

10. A developing device according to claim 1, wherein an area of the third communication opening is larger than an area of the developer discharge opening.

11. A developing device according to claim 1, wherein a lower end portion of the third communication opening is positioned above a lower end portion of the second communication opening with respect to a vertical direction.

12. A developing device according to claim 1, further comprising an air-discharging opening provided above the second feeding screw with respect to a vertical direction and through which air is discharged from an inside to an outside of the developing container.

13. A developing device according to claim 1, further comprising a developer supplying opening provided in the second chamber and disposed upstream of the first communication opening with respect to the second direction so as to supply the developer to the developing container.

14. A developing device comprising:

a rotatable developing member configured to carry and feed a developer containing toner and a carrier to a position where an electrostatic latent image formed on an image bearing member is developed;

a developing container including a first chamber in which the rotatable developing member is provided and in which the developer is supplied to the rotatable developing member and a second chamber which is partitioned from the first chamber by a partition wall and in which the developer is circulated between itself and the first chamber;

a first communication opening configured to permit communication of the developer from the first chamber to the second chamber;

a second communication opening configured to permit communication of the developer from the second chamber to the first chamber;

a first feeding screw provided in the first chamber and including:

a first rotation shaft;

a first blade portion provided upstream of a downstream end of the first communication opening with respect to a first direction from the second communication opening toward the first communication opening and formed in a helical shape on an outer peripheral surface of the first rotation shaft so as to feed the developer in the first direction;

a second blade portion provided downstream of an upstream end of the first communication opening and the first blade portion with respect to the first direction and formed in a helical shape on the outer peripheral surface of the first rotation shaft so as to feed the developer in the first direction; and a third blade portion provided downstream the first blade portion and upstream of the second blade portion with respect to the first direction and formed in a helical shape on the outer peripheral surface of the first rotation shaft so as to feed the developer in a second direction opposite to the first direction;

a second feeding screw provided in the second chamber and including:

a second rotation shaft;

a fourth blade portion provided downstream of an upstream end of the first communication opening with respect to the second direction and formed in a helical shape on an outer peripheral surface of the second rotation shaft so as to feed the developer in the second direction; and a fifth blade portion provided upstream of a downstream end of the first communication opening and the fourth blade portion with respect to the second direction and formed in a helical shape on the outer peripheral surface of the second rotation shaft so as to feed the developer in the second direction;

a developer discharge opening provided in the first chamber and disposed downstream of the downstream end of the first communication opening with respect to the first direction so as to discharge the developer from the developing container; and a third communication opening provided downstream of the downstream end of the first communication opening with respect to the first direction so as to permit communication of airflow between the first chamber and the second chamber, wherein with respect to the first direction, the third communication opening overlaps with the second blade portion, wherein with respect to the second direction, the third communication opening overlaps with the fifth blade portion, and wherein with respect to the first direction, an upstream end of the third communication opening is positioned upstream of an upstream end of the developer discharge opening.

15. A developing device according to claim 14, wherein with respect to the first direction, the third communication opening overlaps with the developer discharge opening.

16. A developing device according to claim 14, wherein with respect to the first direction, a downstream end of the third communication opening is positioned upstream of the upstream end of the developer discharge opening.

17. A developing device according to claim 14, wherein in a case that a pitch per rotation of the second blade portion is P, a diameter of the second blade portion is Lb, a diameter of the first rotation shaft is Ls, a diameter per rotation of the fifth blade portion is P', a diameter of the fifth blade portion is Lb', and a diameter of the second rotation shaft is Ls', the following relationship is satisfied:

$$\pi\times((Lb/2)^2-(Ls/2)^2)\times P\leq\pi\times((Lb'/2)^2-(Ls'/2)^2)\times P'.$$

18. A developing device according to claim 17, wherein the following relationship is satisfied:

$$\pi\times((Lb/2)^2-(Ls/2)^2)\times P\leq\pi\times((Lb'/2)^2-(Ls'/2)^2)\times P'.$$

19. A developing device according to claim 14, wherein in a case that a pitch per rotation of the second blade portion is P, a diameter of the second blade portion is Lb, a diameter of the first rotation shaft is Ls, a number of threads of the second blade portion is M, a number of rotations per unit time of the first feeding screw is N, a pitch per rotation of the fifth blade portion is P', a diameter of the fifth blade portion is Lb', a diameter of the second rotation shaft is Ls', a number of threads of the fifth blade portion is M', and a number of rotations per unit time of the second feeding screw is N', the following relationship is satisfied:

$$\pi\times((Lb/2)^2-(Ls/2)^2)\times P\times M\times N<\pi\times((Lb'/2)^2-(Ls'/2)^2)\times P'\times M'\times N'.$$

20. A developing device according to claim 14, wherein the first feeding screw further includes a sixth blade portion provided downstream of the second blade portion with respect to the first direction and formed in a helical shape on the outer peripheral surface of the first rotation shaft so as to feed the developer in the second direction, wherein with respect to the second direction, the developer discharge opening overlaps with the sixth blade portion.

21. A developing device according to claim 14, wherein an area of the third communication opening is larger than an area of the developer discharge opening.

22. A developing device according to claim 14, wherein a lower end portion of the third communication opening is positioned above a lower end portion of the second communication opening with respect to a vertical direction.

23. A developing device according to claim 14, further comprising an air-discharging opening provided above the second feeding screw with respect to a vertical direction and through which air is discharged from an inside to an outside of the developing container.

24. A developing device according to claim 14, further comprising a developer supplying opening provided in the second chamber and disposed upstream of the first communication opening with respect to the second direction so as to supply the developer to the developing container.

25. A developing device comprising:

a rotatable developing member configured to carry and feed a developer containing toner and a carrier to a position where an electrostatic latent image formed on an image bearing member is developed;

a developing container including a first chamber in which the rotatable developing member is provided and in which the developer is supplied to the rotatable developing member and a second chamber which is partitioned from the first chamber by a partition wall and in which the developer is circulated between itself and the first chamber;

a first communication opening configured to permit communication of the developer from the first chamber to the second chamber;

a second communication opening configured to permit communication of the developer from the second chamber to the first chamber;

a first feeding screw provided in the first chamber and including:

a first rotation shaft;

a first blade portion provided downstream of an upstream end of the second communication opening with respect to a first direction from the second communication opening toward the first communication opening and formed in a helical shape on an outer peripheral surface of the first rotation shaft so as to feed the developer in the first direction; and a second blade portion provided upstream of a downstream end of the second communication opening and the first blade portion with respect to the first direction and formed in a helical shape on the outer peripheral surface of the first rotation shaft so as to feed the developer in the first direction;

a second feeding screw provided in the second chamber and including:

a second rotation shaft;

a third blade portion provided upstream of a downstream end of the second communication opening with respect to the second direction and formed in a helical shape on an outer peripheral surface of the second rotation shaft so as to feed the developer in a second direction opposite to the first direction;

a fourth blade portion provided downstream of an upstream end of the second communication opening and the third blade portion with respect to the second direction and formed in a helical shape on the outer peripheral surface of the second rotation shaft so as to feed the developer in the second direction; and a fifth blade portion provided downstream of the third blade portion and upstream of the fourth blade portion with respect to the second direction and formed in the helical shape on the outer peripheral surface of the second rotation shaft so as to feed the developer in the first direction;

a developer discharge opening provided in the second chamber and disposed downstream of the downstream end of the second communication opening with respect to the second direction so as to discharge the developer from the developing container; and a third communication opening provided downstream of the downstream end of the second communication opening with respect to the second direction so as to permit communication of airflow between the first chamber and the second chamber, wherein with respect to the second direction, the third communication opening overlaps with the fourth blade portion, wherein with respect to the first direction, the third communication opening overlaps with the second blade portion, and wherein with respect to the second direction, an upstream end of the third communication opening is positioned upstream of an upstream end of the developer discharge opening.

26. A developing device according to claim 25, wherein with respect to the second direction, the third communication opening overlaps with the developer discharge opening.

27. A developing device according to claim 25, wherein with respect to the second direction, a downstream end of the third communication opening is positioned upstream of the upstream end of the developer discharge opening.

28. A developing device according to claim 25, wherein in a case that a pitch per rotation of the fourth blade portion is P, a diameter of the fourth blade portion is Lb, a diameter of the second rotation shaft is Ls, a diameter per rotation of the second blade portion is P', a diameter of the second blade portion is Lb', and a diameter of the first rotation shaft is Ls', the following relationship is satisfied:

$$\pi\times((Lb/2)^2-(Ls/2)^2)\times P<\pi\times((Lb'/2)^2-(Ls'/2)^2)\times P'.$$

29. A developing device according to claim 28, wherein the following relationship is satisfied:

$$\pi\times((Lb/2)^2-(Ls/2)^2)\times P<\pi\times((Lb'/2)^2-(Ls'/2)^2)\times P'.$$

30. A developing device according to claim 25, wherein in a case that a pitch per rotation of the fourth blade portion is P, a diameter of the fourth blade portion is Lb, a diameter of the second rotation shaft is Ls, a number of threads of the fourth blade portion is M, a number of rotations per unit time of the second feeding screw is N, a pitch per rotation of the second blade portion is P', a diameter of the second blade portion is Lb', a diameter of the first rotation shaft is Ls', a number of threads of the second blade portion is M', and a number of rotations per unit time of the first feeding screw is N', the following relationship is satisfied:

$$\pi\times((Lb/2)^2-(Ls/2)^2)\times P\times M\times N<\pi\times((Lb'/2)^2-(Ls'/2)^2)\times P'\times M'\times N'.$$

31. A developing device according to claim 25, wherein the second feeding screw further includes a sixth blade portion provided downstream of the fourth blade portion with respect to the second direction and formed in a helical shape on the outer peripheral surface of the second rotation shaft so as to feed the developer in the first direction, wherein with respect to the first direction, the developer discharge opening overlaps with the sixth blade portion.

32. A developing device according to claim 25, wherein an area of the third communication opening is larger than an area of the developer discharge opening.

33. A developing device according to claim 25, wherein a lower end portion of the third communication opening is positioned above a lower end portion of the second communication opening with respect to a vertical direction.

34. A developing device according to claim 25, further comprising an air-discharging opening provided above the second feeding screw with respect to a vertical direction and through which air is discharged from an inside to an outside of the developing container.

35. A developing device according to claim 25, further comprising a developer supplying opening provided in the second chamber and disposed upstream of the first communication opening with respect to the second direction so as to supply the developer to the developing container.

* * * * *